US007289094B2

(12) United States Patent
Yamaguchi

(10) Patent No.: US 7,289,094 B2
(45) Date of Patent: Oct. 30, 2007

(54) DEVICE CIRCUIT FOR FLAT DISPLAY APPARATUS AND FLAT DISPLAY APPARATUS

(75) Inventor: Masanori Yamaguchi, Kanagawa (JP)

(73) Assignee: Sony Corporation (JP)

( * ) Notice: Subject to any disclaimer, the term of this patent is extended or adjusted under 35 U.S.C. 154(b) by 443 days.

(21) Appl. No.: 11/099,525

(22) Filed: Apr. 6, 2005

(65) Prior Publication Data

US 2005/0225466 A1 Oct. 13, 2005

(30) Foreign Application Priority Data

Apr. 8, 2004 (JP) ..... 2004-114728

(51) Int. Cl.
*G09G 3/36* (2006.01)

(52) U.S. Cl. ..... 345/89; 345/87

(58) Field of Classification Search ..... 345/76–100, 345/200, 204, 208–213
See application file for complete search history.

(56) References Cited

U.S. PATENT DOCUMENTS 6,762,737 B2 * 7/2004 Kajihara et al. ..... 345/89
2003/0201959 A1 * 10/2003 Sakaguchi ..... 345/87
2004/0021627 A1 * 2/2004 Maki ..... 345/89

FOREIGN PATENT DOCUMENTS

JP 10-333648 12/1998

* cited by examiner

*Primary Examiner*—Alexander Eisen
*Assistant Examiner*—Kenneth B Lee
(74) *Attorney, Agent, or Firm*—Rader Fishman & Grauer PLLC; Ronald P. Kananen

(57) ABSTRACT

A drive circuit for a flat display apparatus which may include organic EL devices is disclosed wherein the light emission characteristic can be set variously and the color adjustment can be performed with a high degree of accuracy with a simple and easy configuration. A plurality of candidate voltages from voltage dividing circuits are selected in response to original reference voltage setting data to produce original reference voltages, and reference voltages for digital to analog conversion are produced from the original reference voltages. For the original reference voltages at the opposite ends of the voltage dividing circuits, the voltages of production references are varied with rough adjustment data, and the other original reference voltages are produced with reference to the original reference voltages at the opposite ends by the voltage dividing circuits connected in series.

5 Claims, 16 Drawing Sheets

DEVICE CIRCUIT FOR FLAT DISPLAY APPARATUS AND FLAT DISPLAY APPARATUS

BACKGROUND OF THE INVENTION

This invention relates to a drive circuit for a flat display apparatus and a flat display apparatus which can be applied to a display apparatus which is configured using, for example, organic EL (Electro Luminescence) devices.

Conventionally, a liquid crystal display apparatus which is a flat display apparatus is configured such that the gamma characteristic is changed over by setting of a reference voltage to be used for a digital to analog conversion process as disclosed, for example, in Japanese Patent Laid-Open No. Hei 10-333648 (hereinafter referred to as Patent Document 1).

A typical liquid crystal display apparatus is shown in FIG. 8. Referring to FIG. 8, the liquid crystal display apparatus 1 shown includes a display section 2 in which pixels (P) 3R, 3G, 3B each formed from a liquid crystal cell, a switching element for the liquid crystal cell and a holding capacitor are arranged in a matrix. In the liquid crystal display apparatus 1, each of the pixels 3R, 3G, 3B is connected to a horizontal drive circuit 4 and a vertical drive circuit 5 through a signal line (column line) SIG and a gate line (row line) G, respectively. The vertical drive circuit 5 successively selects the pixels 3R, 3G, 3B while the horizontal drive circuit 4 sets the gradations of the pixels 3R, 3G, 3B using driving signals therefrom thereby to display a desired image. Further, the pixels 3R, 3G, 3B having color filters of red, green and blue provided therefor are arranged successively and cyclically so that a color image can be displayed.

To this end, in the liquid crystal display apparatus 1, image data DR, DG, DB of red, green and blue to be used for display are inputted simultaneously and parallelly from an apparatus body 6 to a controller 7, and the gate lines G of the display section 2 are driven by the vertical drive circuit 5 with timing signals synchronized with the image data DR, DG, DB. Further, the image data DR, DG, DB are time division multiplexed to produce a single series of image data D1 so as to correspond to driving of the signal lines SIG by the horizontal drive circuit 4, and the signal lines SIG are driven by the horizontal drive circuit 4 with the thus produced image data D1.

FIG. 9 is a block diagram showing a detailed configuration of the horizontal drive circuit 4 and the controller 7. Referring to FIG. 9, the controller 7 successively stores and outputs image data DR, DG, DB outputted from the apparatus body 6 into and from a memory 10 under the control of a memory control circuit 9 to time division multiplex and output the image data DR, DG, DB in a single system such that image data of the same color may successively appear in a unit of a line in a unit of a horizontal scanning period so as to correspond to driving of the signal lines SIG by the horizontal drive circuit 4. More particularly, the horizontal drive circuit 4 successively drives the red pixels 3R, green pixels 3G and blue pixels 3B in a unit of a line, and consequently, the controller 7 outputs the image data D1 such that the red image data DR, green image data DG and blue image data DB are repeated successively and cyclically in a unit of a line as seen from FIG. 10B.

The controller 7 produces various timing signals synchronized with the image data D1 by means of a timing generator (TG) 11 and outputs the timing signals to the horizontal drive circuit 4 and the vertical drive circuit 5. It is to be noted that the timing signals include a clock CK (FIG. 10A) for the image data D1, a start pulse ST (FIG. 10C) and a strobe pulse (FIG. 10D) indicative of timings of a start and an end of the image data DR, DG, DB of the different colors of the image data D1.

The controller 7 produces original reference voltages VRT, VB to VG, VRB, which are used as references for production of reference voltages to be used for a digital analog conversion process, by means of an original reference signal production circuit 12 and outputs them to the horizontal drive circuit 4.

The horizontal drive circuit 4 inputs image data D1 outputted from the controller 7 to a shift register 13 so that the image data D1 are successively distributed and outputted to systems of signal lines of the display section 2. The reference voltage production circuit 14 produces and outputs reference voltages V1 to V64, which correspond to different gradations of the image data D1, from the original reference voltages VRT, VB to VG, VRB inputted thereto from the controller 7.

Digital to analog conversion circuits (D/A) 15A to 15N perform a digital to analog conversion process for output data of the shift register 13 and output drive signals which are time division multiplexed drive signals of three adjacent ones of the signal lines SIG. The digital to analog conversion circuits 15A to 15N selectively output the reference voltages V1 to V64 produced by a reference voltage production circuit 14 in response to output data of the shift register 13 to perform a digital to analog conversion process of the image data outputted from the shift register 13.

Amplification circuits 16A to 16N amplify and output the output signals of the digital to analog conversion circuits 15A to 15N to the display section 2, respectively. In the display section 2, the output signals of the amplification circuits 16A to 16N are successively and cyclically outputted to the signal lines SIG for the pixels 3R, 3G, 3B of red, green and blue by means of selectors 17A to 17N, respectively.

In this manner, the reference voltages V1 to V64 produced from the original reference voltages VRT, VB to VG, VRB are selectively used to produce drive signals for the signal lines SIG. FIG. 11 shows in block diagram a configuration of the original reference signal production circuit 12 used to produce the original reference voltages VRT, VB to VG, VRB and the reference voltage production circuit 14 used to produce the reference voltages V1 to V64.

Referring to FIG. 11, the original reference signal production circuit 12 shown includes a voltage dividing circuit 21 formed from a predetermined number of resistors connected in series. The voltage dividing circuit 21 divides a reference voltage production voltage VCOM to produce the original reference voltages VRT, VB to VG, VRB. Consequently, the original reference signal production circuit 12 produces the original reference voltages VRT, VB to VG, VRB by resistor voltage division and outputs them through amplification circuits 24A to 27H. It is to be noted that, where the liquid crystal display apparatus 1 is applied to a liquid crystal display apparatus, the original reference signal production circuit 12 is configured such that the voltage to be applied to the voltage dividing circuit 21 is changed over by a selection circuit 22 and an inversion amplification circuit 23 so as to cope with line inversion or frame inversion. FIG. 10F illustrates the potential of a signal line SIG where line inversion is involved.

Meanwhile, the reference voltage production circuit 14 includes a resistor series circuit 26 formed from voltage dividing circuits R1 to R7 connected in series. Each of the voltage dividing circuits R1 to R7 includes a predetermined number of resistors having an equal resistance value and connected in series. The original reference voltages VRT, VB to VG, VRB are inputted through amplification circuits 27A to 27H to one end of the resistor series circuit 26, nodes of the voltage dividing circuits R1 to R7 which form the resistor series circuit 26 and the other end of the resistor series circuit 26, respectively. Consequently, the reference voltage production circuit 14 divides potential differences by the original reference voltages VRT, VB to VG, VRB produced by the original reference signal production circuit 12 further by means of the voltage dividing circuits R1 to R7 to produce the reference voltages V1 to V64 within the range of the original reference voltages VRT and VRB.

Since the reference voltages V1 to V64 are produced from the original reference voltages VRT, VB to VG, VRB in this manner, the numbers of resistors which form the voltage dividing circuits R1 to R7 of the reference voltage production circuit 14 are individually set to predetermined numbers, and the original reference voltages VRT, VB to VG, VRB are divided so that a plurality of reference voltages V1 to V64 corresponding to gradations of the image data D1 can be outputted.

In the original reference signal production circuit 12, the values of the resistors which form the voltage dividing circuit 21 are set so that an image may be displayed with a desired gamma characteristic by means of the reference voltages V1 to V64 corresponding to the gradations of the image data D1 in this manner. Consequently, as seen from a curve L1 in FIG. 12 where the voltage VCOM is set to 5 V, a desired gamma characteristic can be assured by polygonal line approximation depending upon setting of the original reference voltages VRT, VB to VG, VRB. Further, in the original reference signal production circuit 12, the original reference voltages VRT, VB to VG, VRB to be outputted from the voltage dividing circuit 21 can be changed over by a change of the wiring line pattern. Thus, as seen from a curve L2 shown for contrast with the characteristic indicated by the curve L1 in FIG. 12, for example, while the original reference voltages VRT and VRB which are potentials at the opposite ends are fixed, the remaining original reference voltages VB to VG can be varied within a range indicated by arrow marks to vary the gamma characteristic variously.

In the liquid crystal display apparatus 1 wherein the gamma characteristic can be changed over by setting of the original reference signal production circuit 12 which produces the original reference voltages VRT, VB to VG, VRB in this manner, while the controller 7 including the original reference signal production circuit 12 is formed from a control IC, the horizontal drive circuit 4 is formed from a driver IC. Consequently, according to the liquid crystal display apparatus 1, products of different gamma characteristics can be produced by replacing only the control IC, and consequently, upon modification to the gamma characteristic, the period of time required for the modification can be reduced. It is to be noted that reference characters CA to CH denote stray capacitances between the two ICs.

Incidentally, one of such flat display apparatuses as described above is a display apparatus which uses organic EL devices. Also with regard to a display section of such a display apparatus which uses organic EL devices as just described, a method has been proposed wherein gradations of the individual organic EL devices are set by driving of signal lines SIG similarly as in the case of the display section of the liquid crystal display apparatus described above. It is estimated that the display section of organic EL devices which uses the method just described can be applied to a configuration of a display apparatus using a control IC used in the liquid crystal display apparatus or a like apparatus.

However, where organic EL elements are used, the light emission characteristic differs among different colors and among different products, and besides it exhibits a secular change. Therefore, it is necessary to set the reference voltages V1 to V64 differently in accordance with the light emission characteristics of the organic EL devices. This gives rise to a problem that the drive circuit of the liquid crystal display apparatus described hereinabove with reference to FIG. 8 cannot be applied to an actual configuration of a display apparatus. In particular, where organic EL elements are used, it is necessary to adjust the black level and the dynamic range for each color and for each product. It is to be noted that it is known that the gamma characteristic itself of an organic EL device does not require any adjustment. Consequently, where the original reference signal production circuit 12 shown in FIG. 11 is applied, it is necessary to adjust the voltage across the voltage dividing circuit 21 for each color and for each product.

One of possible solutions to the problem just described is, for example, to configure an original reference voltage production circuit 30 in such a manner as seen in FIG. 13. Referring to FIG. 13, in the original reference voltage production circuit 30 shown, digital to analog conversion circuits (D/A) 31A to 31H produce original reference voltages VRT, VB to VG, VRB individually in response to original reference voltage setting data DV.

Of the digital to analog conversion circuits 31A to 31H, the digital to analog conversion circuits 31A and 31H used for production of the original reference voltages VRT and VRB set to the voltages at the opposite ends divide the reference voltage production voltage VCOM by means of the voltage dividing circuits 32A and 32H to produce a plurality of candidate voltages for original reference voltages. The voltage dividing circuits 32A and 32H are each formed from a series circuit of a plurality of resistors having an equal resistance value, and divide the reference voltage production voltage VCOM with a resolution corresponding to the number of bits of the original reference voltage setting data DV and outputs the divided voltages.

Selectors 33A and 33H select a plurality of candidate voltages outputted from the voltage dividing circuits 32A and 32H in response to the original reference voltage setting data DV and produce and output original reference voltages VRT and VRB in response to the original reference voltage setting data DV, respectively.

Meanwhile, the other digital to analog conversion circuits 31B to 31G except the digital to analog conversion circuits 31A and 31H produce, similarly to the digital to analog conversion circuits 31A and 31H, a plurality of candidate voltages for the original reference voltages VB to VG from divided voltages by the voltage dividing circuits 32B to 32G and selectively output the candidate voltages to the original reference voltages VB to VG in response to the original reference voltage setting data DV by means of selectors 33B to 33G. The digital to analog conversion circuits 31B to 31G are connected to the original reference voltages VRT and VRB from the digital to analog conversion circuits 31A and 31H while the voltage dividing circuits 32B to 32G used to produce candidate voltages for the original reference voltages VB to VG are connected in series between the digital to analog conversion circuits 31B to 31G.

A decoder 35 successively fetches the original reference voltage setting data DV outputted from the controller or the like and selectively outputs the fetched data to the digital to analog conversion circuits 31A to 31H at timings corresponding to changeover of contacts in the selectors 17A to 17N.

According to the configuration described above, it is possible to set the original reference voltage setting data DV for each color so as to cope with the light emission characteristic which differs among different colors. Further, the original reference voltage setting data DV can be set for each product to correct the dispersion in light emission characteristic which depends upon the product. Further, also it is possible to cope with a secular change of the light emission characteristic.

Further, as seen from FIG. 14, in the case of the original reference voltages VB to VG except the potentials at the opposite ends from among the original reference voltages VRT, VB to VG, VRB, it is difficult to vary the voltage exceeding the ranges of the candidate voltages outputted from the voltage dividing circuits 32B to 32G connected in series to each other. Therefore, as seen from FIG. 15 in comparison with FIG. 14, even if the original reference voltage setting data DV is set because of invasion of noise, outputting of a drive signal of an extreme gamma characteristic can be prevented, and significant deterioration of the picture quality by noise can be prevented.

Further, since the opposite ends of the voltage dividing circuits 32B to 32G connected in series to each other in this manner are connected to the original reference voltages VRT and VRB used as the first and second original reference voltages, if the original reference voltages VRT and VRB are varied by black level adjustment or dynamic range adjustment which is correction of the light emission characteristic, then also the original reference voltages VB to VG vary following up the variation of the original reference voltages VRT and VRB in accordance with the resistor voltage dividing ratio by the voltage dividing circuits 32B to 32G connected in series to each other as seen from FIG. 16 in comparison with FIG. 14. In other words, any dispersion in light emission characteristic of each organic EL device can be corrected by black level adjustment or dynamic range adjustment without providing any variation to the gamma characteristic. Consequently, the adjustment operation can be simplified.

Further, by changing the setting of the original reference voltage setting data DV and further by changing over the line unit or the frame unit, the configuration shown in FIG. 13 can be applied also to a liquid crystal display apparatus.

However, the configuration shown FIG. 13 has a problem in that the dynamic range and the black level cannot be adjusted with a high degree of accuracy, and this may possibly give rise to appearance of a color drift on the display.

In particular, in the example of FIG. 13, for example, if the original reference voltage setting data DV are formed as 6-bit data and the reference voltage production voltage VCOM is set to 5 V, the original reference voltages VRT and VRB can be produced with a resolution of approximately 80 mV (5 [V]/64). In this instance, for example, if a gamma characteristic by a great dynamic range is set as seen in FIG. 14, then a resolution substantially sufficient for practical use is obtained. However, if a gamma characteristic by a small dynamic range as seen in FIG. 16 is set, then the resolution becomes coarse, and consequently, it is difficult after all to adjust the dynamic range and the black level with a high degree of accuracy.

In particular, if the potential difference between the original reference voltages VRT and VRB is set to 5 V, then the resolution for the luminance of the emitted light is 1.6% (80 mV/5,000 [mV]). However, if the potential difference between the original reference voltages VRT and VRB is set to 2 V, then the resolution for the luminance of the emitted light is 4.0% (80 mV/2,000 [mV]), and the accuracy in adjustment drops as much. Thus, a color drift is caused.

In this instance, it is a possible idea to set the resistance values of the resistors from which the voltage dividing circuits 32A and 32H are formed to different values so as to partially enhance the resolutions of the original reference voltages VRT and VRB to be outputted from the selectors 33A and 33H. However, according to this countermeasure, it becomes to set the original reference voltages VRT, VB to VG, VRB to various values. Also it is a possible idea to provide a configuration similar to the configuration which uses the digital to analog conversion circuits 31B to 31G also in each of the digital to analog conversion circuits 31A and 31H so as to produce the original reference voltages VRT and VRB. However, this makes the configuration very complicated. Also it is a possible idea to increase the bit number of the original reference voltage setting data DV relating to the original reference voltages VRT and VRB and configure the voltage dividing circuits 32A and 32H and the selectors 31A and 31H with a resolution increase. According to the countermeasure just described, however, when the dynamic range decreases or in a like case, the integrated circuit must be newly fabricated.

SUMMARY OF THE INVENTION

It is an object of the present invention to provide a drive circuit for a flat display apparatus and a flat display apparatus wherein the gamma characteristic can be set variously and the color adjustment can be performed with a high degree of accuracy with a simple and easy configuration.

In order to attain the object described above, according to the present invention, a plurality of candidate voltages produced by a voltage dividing circuit are selected in response to original reference voltage setting data to produce original reference voltages, and reference voltages for digital to analog conversion are produced from the original reference voltages. With regard to each of the original reference voltages at the opposite ends, the reference voltage is varied with rough adjustment data, and with regard to the remaining original reference voltages, voltage dividing circuits are connected in series to produce the original reference voltages with reference to the original reference voltages at the opposite ends so that the light emission characteristic can be corrected variously. Consequently, the color adjustment can be performed with a high degree of accuracy with a simple and easy configuration.

More particularly, according to an aspect of the present invention, there is provided a drive circuit for a flat display apparatus wherein driving signals are produced by a digital to analog conversion process of image data and are used to drive signal lines of a display section wherein pixels are arranged in a matrix, comprising an original reference voltage production circuit for producing a plurality of original reference voltages, a reference voltage production circuit formed from a plurality of voltage dividing circuits connected in series and each including a plurality of resistors connected in series and receiving the original reference voltages at the opposite ends of and at nodes between the voltage dividing circuits to output divided voltages by the voltage dividing circuits as a plurality reference voltages, a plurality of selection circuits for receiving the reference voltages as inputs thereto and selectively outputting the inputted reference voltages in accordance with the image data for the corresponding ones of the signal lines as the driving signals, and an input circuit for inputting original reference voltage setting data indicating setting of the original reference voltages, the original reference voltage production circuit including a plurality of digital to analog conversion circuits for producing a plurality of candidate voltages for the original reference voltages by means of a voltage dividing circuit for original reference voltage production and selectively outputting the candidate voltages in response to the original reference voltage setting data to produce the original reference voltages corresponding to the original reference voltage setting data, those of the digital analog conversion circuits which are for the original reference voltages other than the potentials at the opposite ends of the voltage dividing circuits being formed such that the voltage dividing circuits for original reference voltage production thereof are connected in series and the original reference voltages of the potentials at the opposite ends of the voltage dividing circuits are inputted to the opposite ends of the voltage dividing circuits for original reference voltage production, each of those of the digital to analog conversion circuit which are for the original reference voltages of the potentials at the opposite ends of the voltage dividing circuits including a power supply circuit for varying the voltage across the voltage dividing circuits for original reference voltage production in response to data for rough adjustment.

In the drive circuit for a flat display apparatus, the original reference voltages other than the original reference voltages of the potentials at the opposite ends of the voltage dividing circuits can be set so as to follow up the original reference voltages of the potentials at the opposite ends. Consequently, the original reference voltages of the potentials at the opposite ends can be produced with a high resolution. Therefore, the drive circuit can cope with various light emission characteristics, and consequently, color adjustment can be performed with a high degree of accuracy with a simple and easy configuration.

According to another aspect of the present invention, there is provided a flat display apparatus for displaying an image based on image data, comprising a display section including pixels arranged in a matrix, and a horizontal drive circuit for driving signal lines of the display section with driving signals, the horizontal drive circuit including an original reference voltage production circuit for producing a plurality of original reference voltages, a reference voltage production circuit formed from a plurality of voltage dividing circuits connected in series and each including a plurality of resistors connected in series and receiving the original reference voltages at the opposite ends of and at nodes between the voltage dividing circuits to output divided voltages by the voltage dividing circuits as a plurality reference voltages, a plurality of selection circuits for receiving the reference voltages as inputs thereto and selectively outputting the inputted reference voltages in accordance with the image data for the corresponding ones of the signal lines as the driving signals, and an input circuit for inputting original reference voltage setting data indicating setting of the original reference voltages, the original reference voltage production circuit including a plurality of digital to analog conversion circuits for producing a plurality of candidate voltages for the original reference voltages by means of a voltage dividing circuit for original reference voltage production and selectively outputting the candidate voltages in response to the original reference voltage setting data to produce the original reference voltages corresponding to the original reference voltage setting data, those of the digital analog conversion circuits which are for the original reference voltages other than the potentials at the opposite ends of the voltage dividing circuits being formed such that the voltage dividing circuits for original reference voltage production thereof are connected in series and the original reference voltages of the potentials at the opposite ends of the voltage dividing circuits are inputted to the opposite ends of the voltage dividing circuits for original reference voltage production, each of those of the digital to analog conversion circuit which are for the original reference voltages of the potentials at the opposite ends of the voltage dividing circuits including a power supply circuit for varying the voltage across the voltage dividing circuits for original reference voltage production in response to data for rough adjustment.

Also with the flat display apparatus, it can cope with various light emission characteristics, and consequently, color adjustment can be performed with a high degree of accuracy with a simple and easy configuration.

The above and other objects, features and advantages of the present invention will become apparent from the following description and the appended claims, taken in conjunction with the accompanying drawings in which like parts or elements denoted by like reference symbols.

DESCRIPTION OF THE PREFERRED EMBODIMENTS

1. Configuration of the Preferred Embodiment

Figure 2:
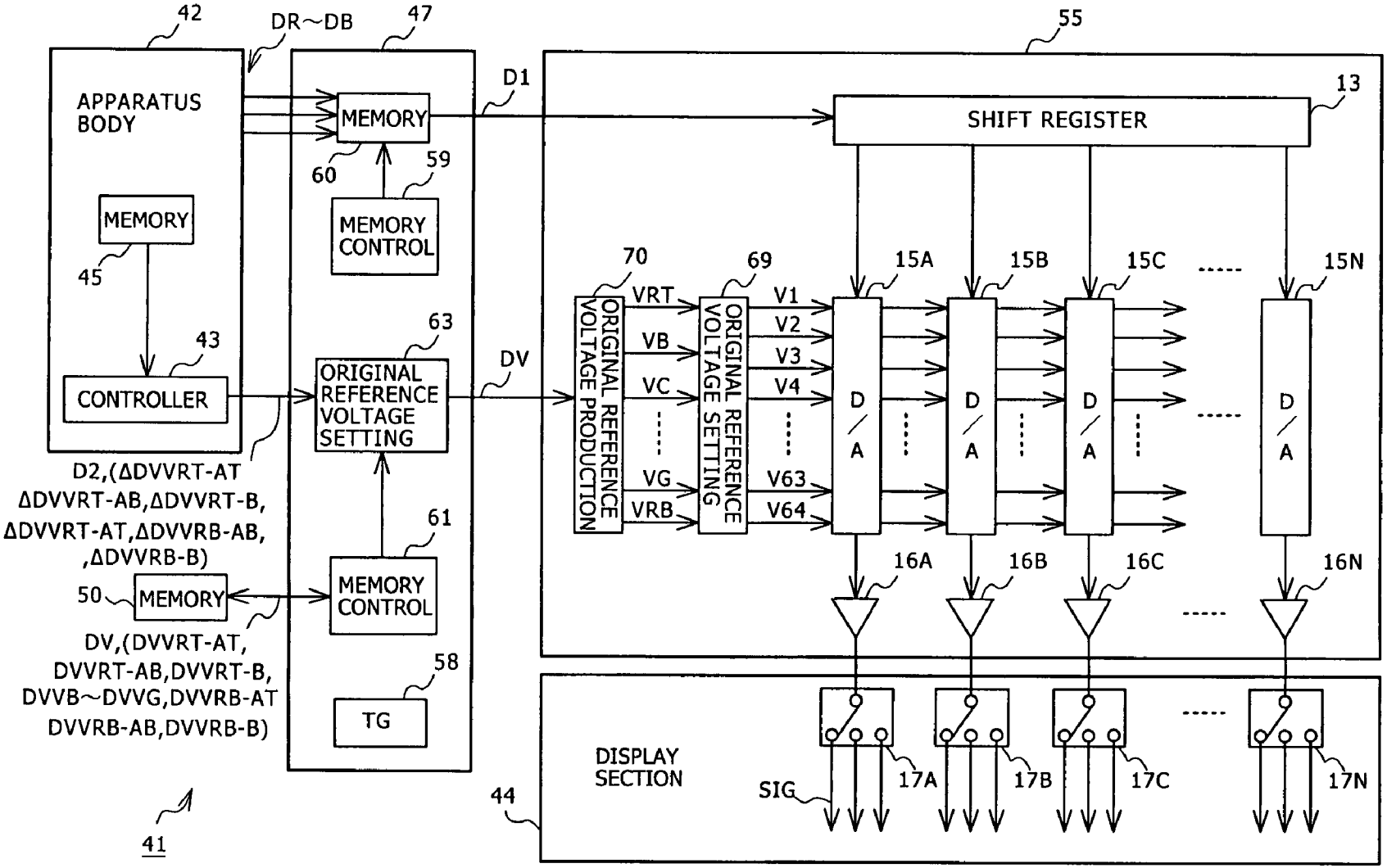
FIG. 2 is a block diagram showing the personal digital assistant according to the first embodiment of the present invention.
Figure 9:
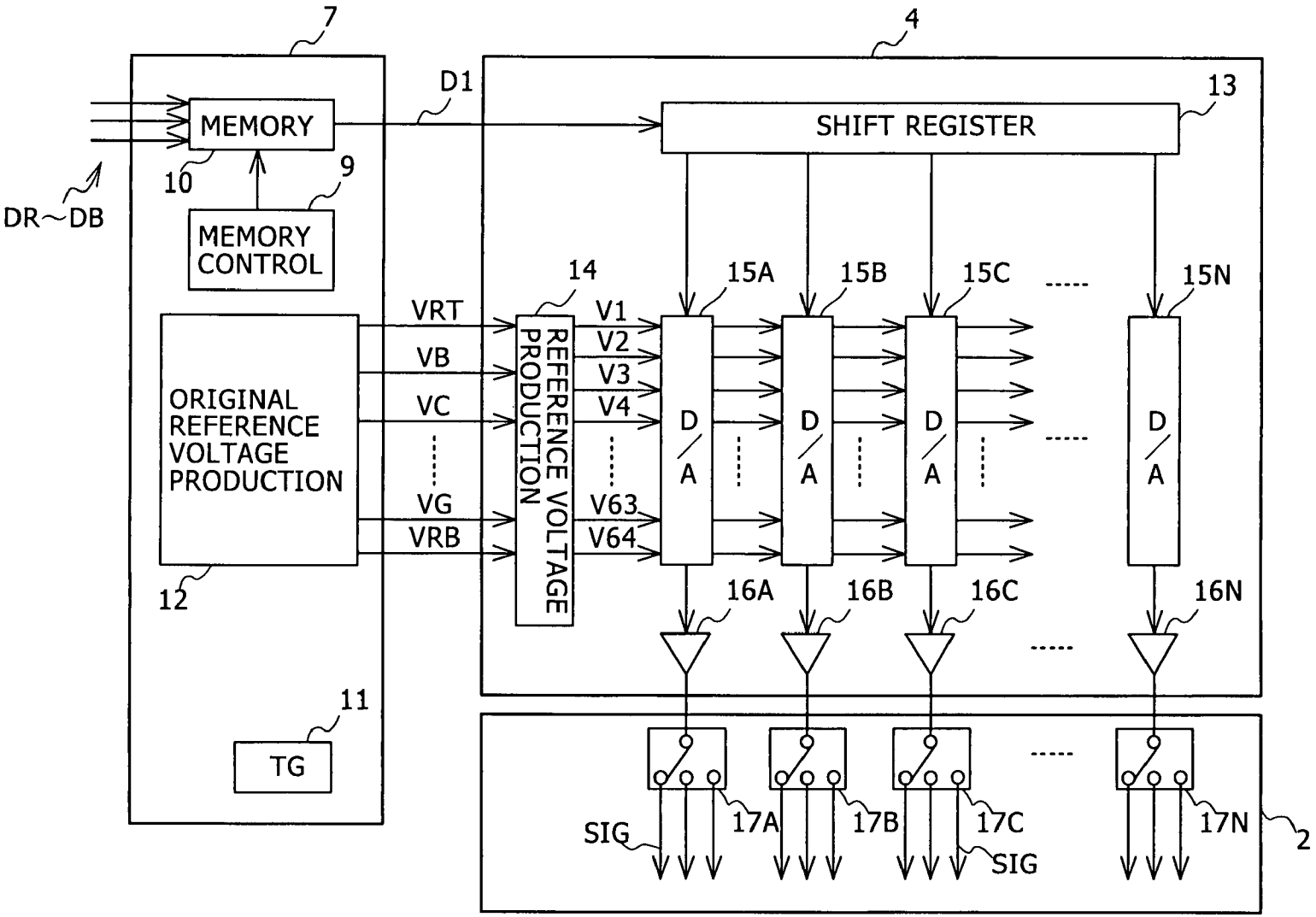
FIG. 9 is a block diagram showing a horizontal drive circuit of the liquid crystal display apparatus of FIG. 8 together with peripheral elements.
Figures 10A, 10B, 10C, 10D, 10E, 10F:
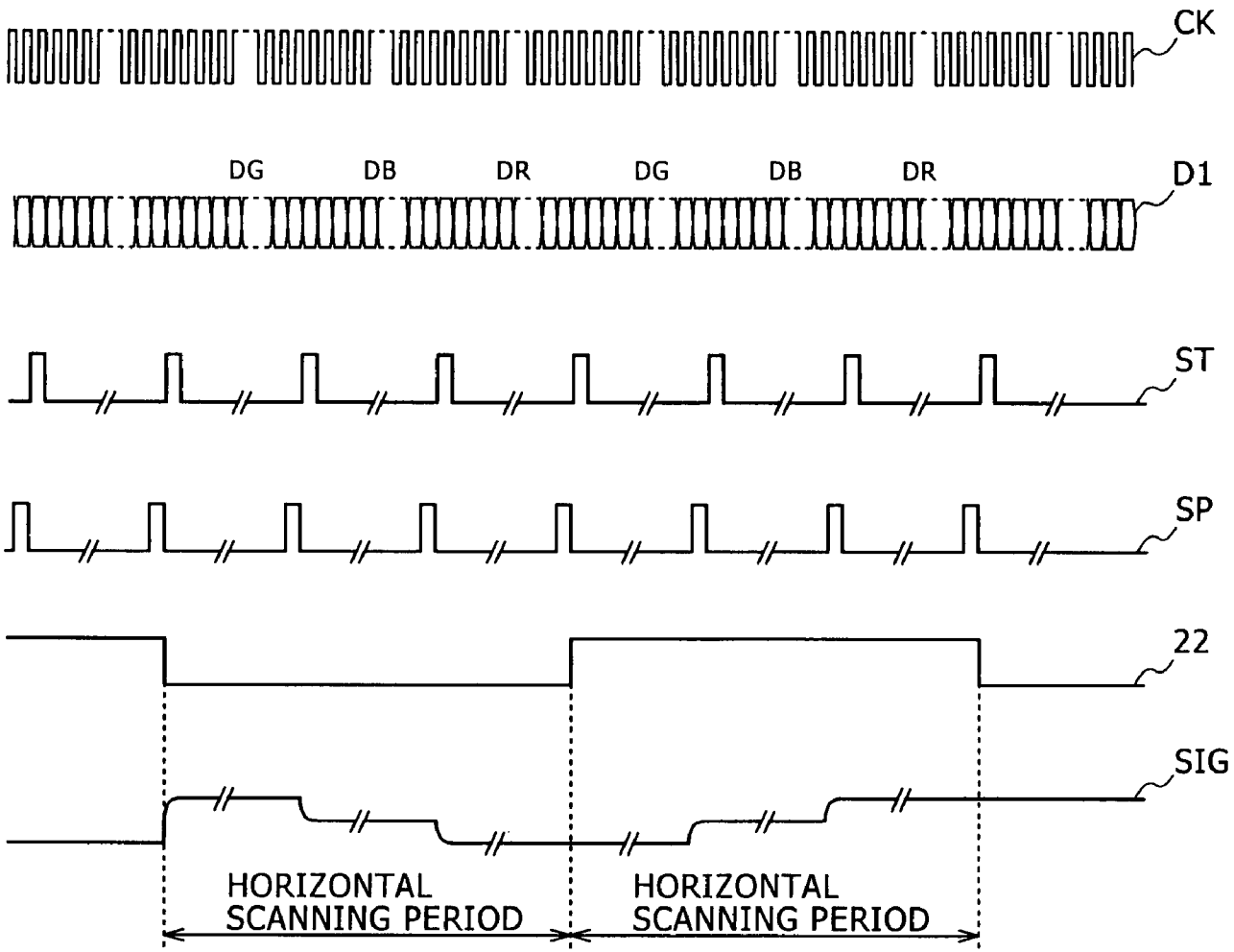
FIG. 10A to 10F are time charts illustrating operation of the horizontal drive circuit shown in FIG. 9.
Figure 11:
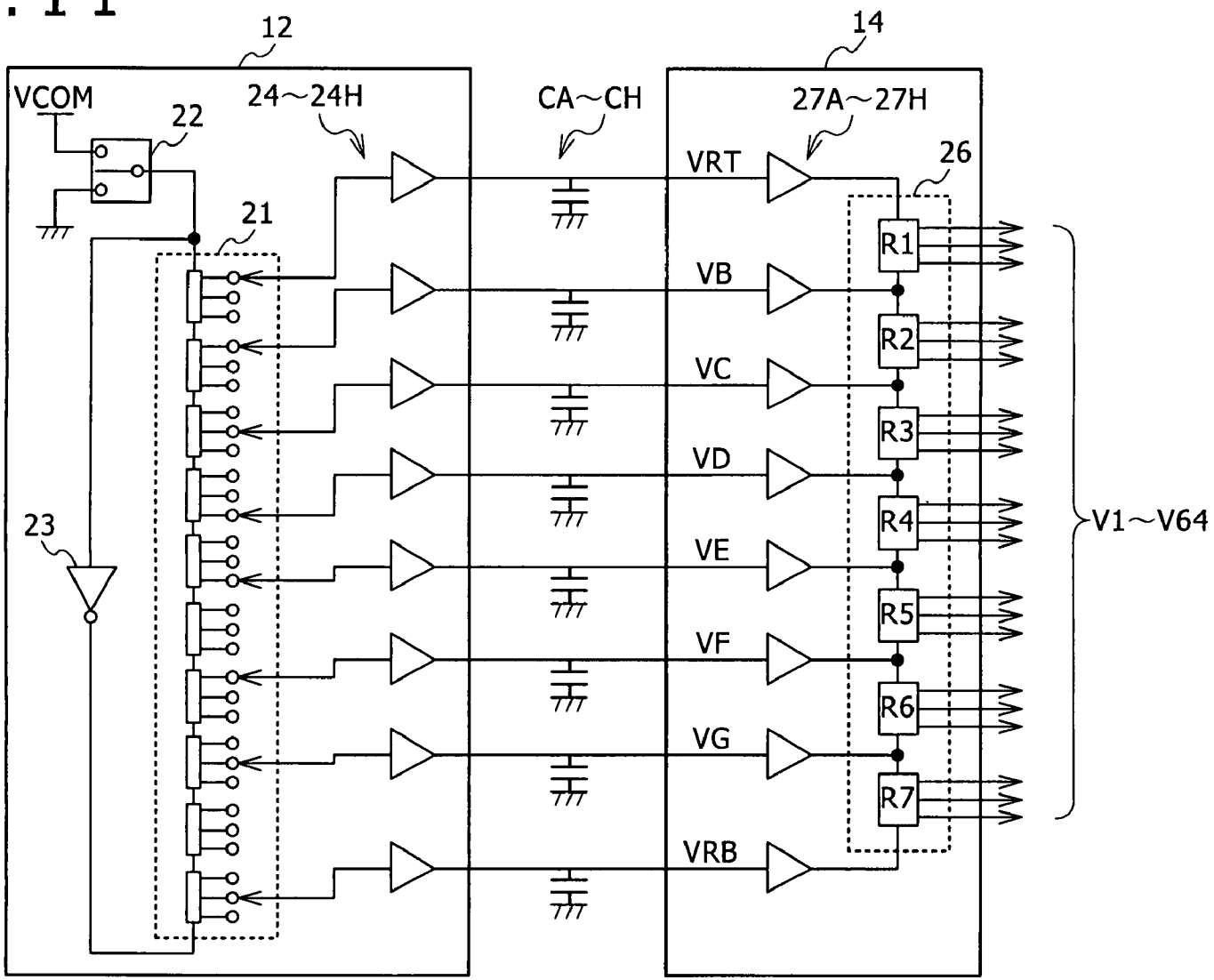
FIG. 11 is a block diagram showing an original reference voltage production circuit and a reference voltage production circuit in a horizontal drive circuit and a controller shown in FIG. 9.
Figure 12:
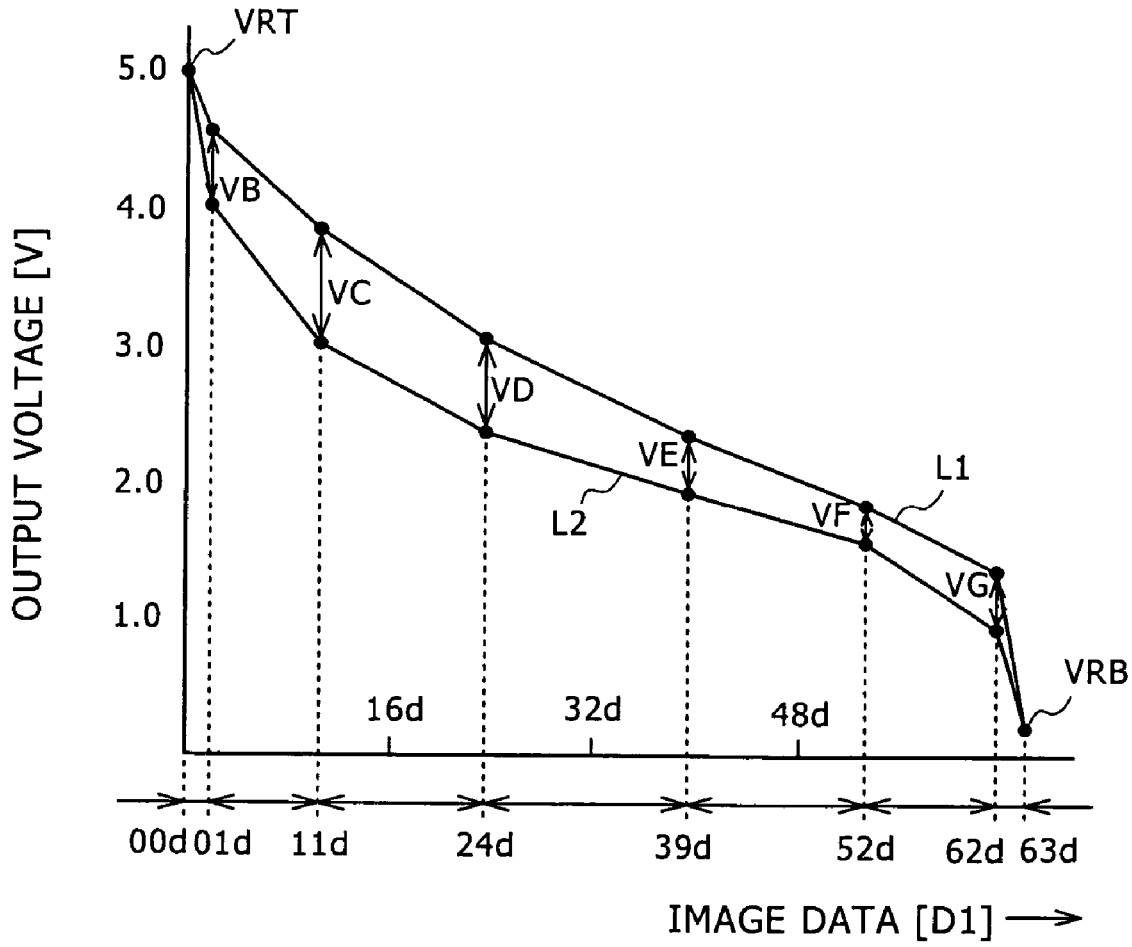
FIG. 12 is a characteristic diagram illustrating a gamma characteristic of the liquid crystal display apparatus of FIG. 8.

FIG. 2 shows in block diagram a PDA (Personal Digital Assistant) to which the present invention is applied. Referring to FIG. 2, the PDA 41 includes an apparatus body 42, a controller 43 serving as an arithmetic operation processing section for executing a predetermined processing procedure in response to an operation of an operation element, and a display section 44 for displaying various images thereon. It is to be noted that, in FIG. 2, like elements to those of FIGS. 9, 10 and 11 are denoted by like reference characters and overlapping description of them is omitted herein to avoid redundancy.

The display section 44 is a color image display panel wherein pixels constructed using an organic EL device are arranged in a matrix. The display section 44 includes gate lines connected to the pixels for selecting the pixels in a unit of a line under the control of a vertical drive circuit not shown and signal lines SIG which are driven to set the gradations of the individual pixels.

Figure 13:
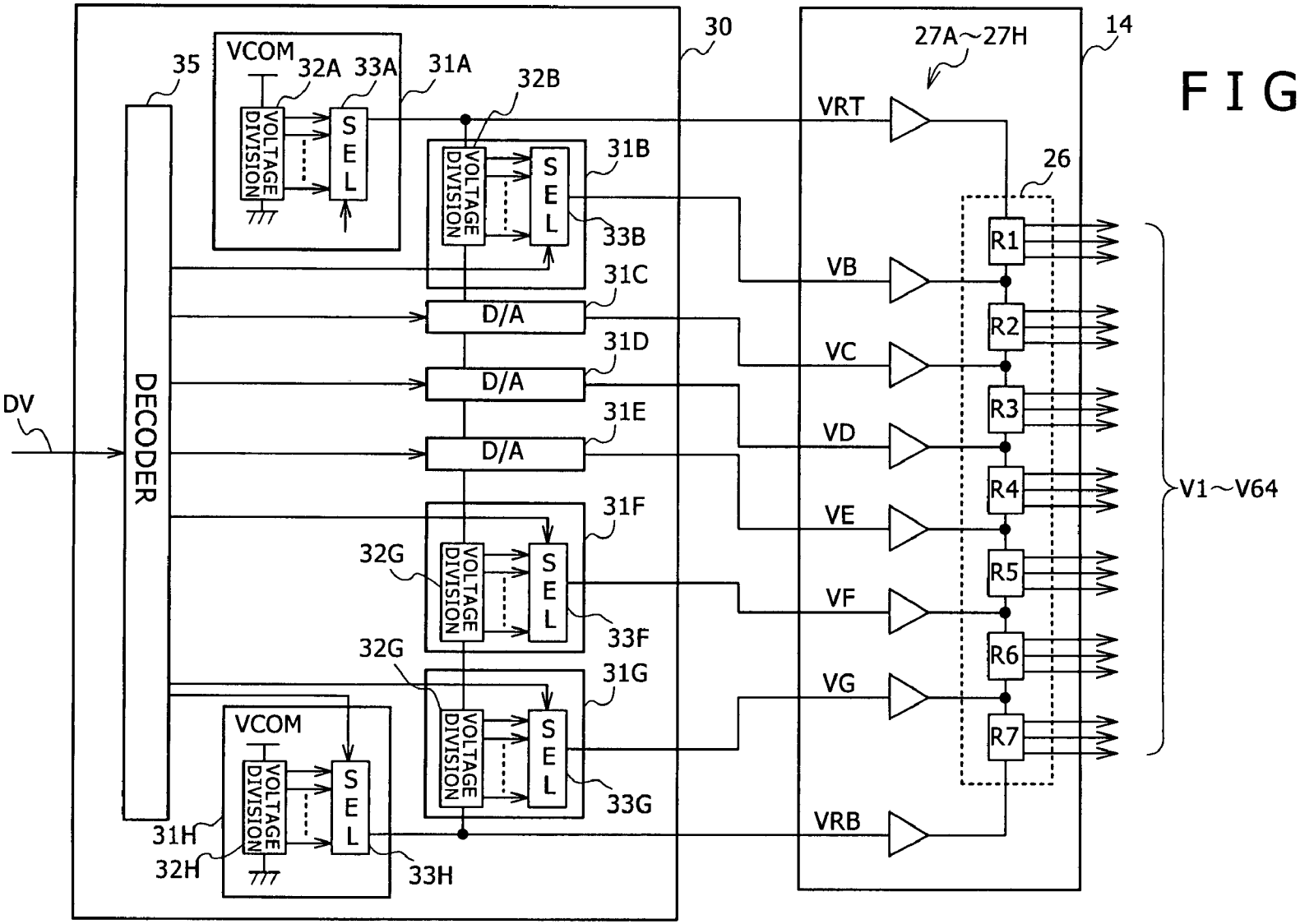
FIG. 13 is a block diagram illustrating an example of setting of original reference voltages based on original reference voltage setting data.
Figure 14:
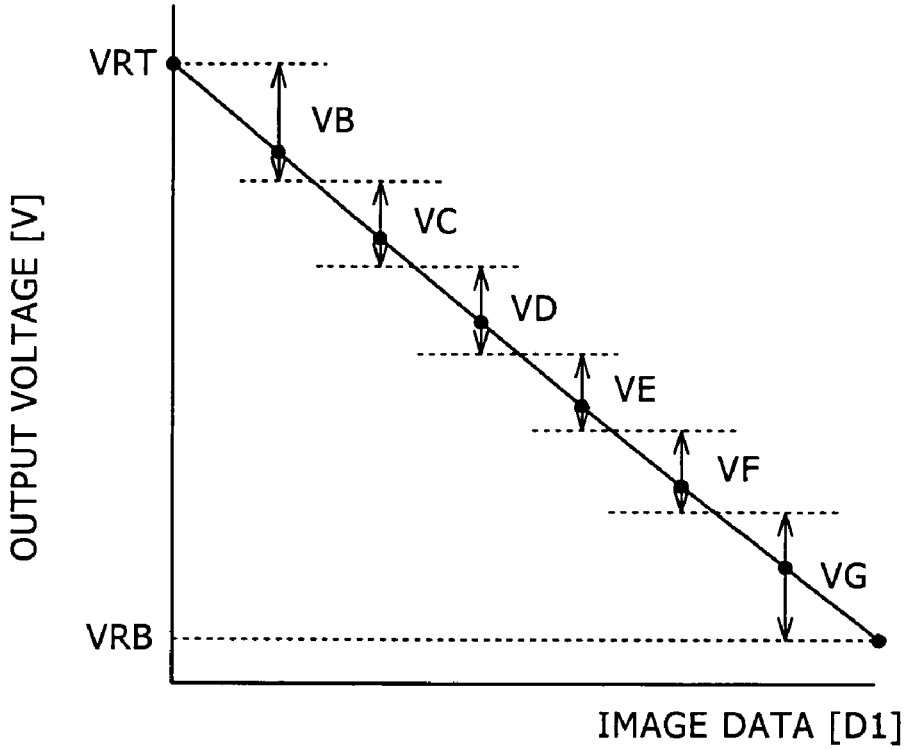
FIG. 14 is a characteristic diagram illustrating a gamma characteristic according to the configuration of FIG. 13.
Figure 15:
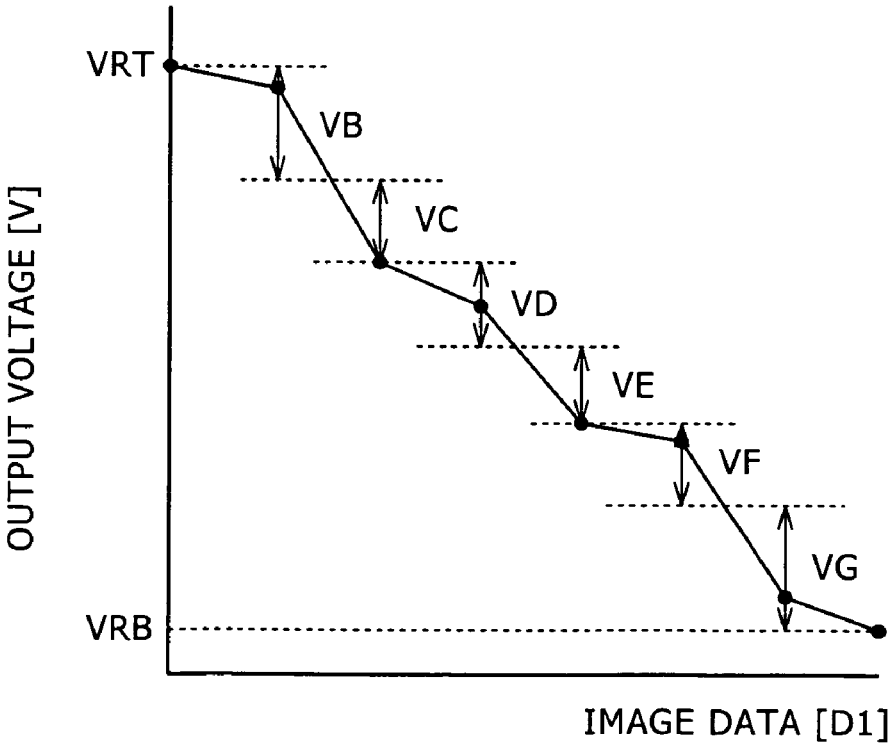
FIG. 15 is a characteristic diagram illustrating an influence of noise on the gamma characteristic according to the configuration of FIG. 13.
Figure 16:
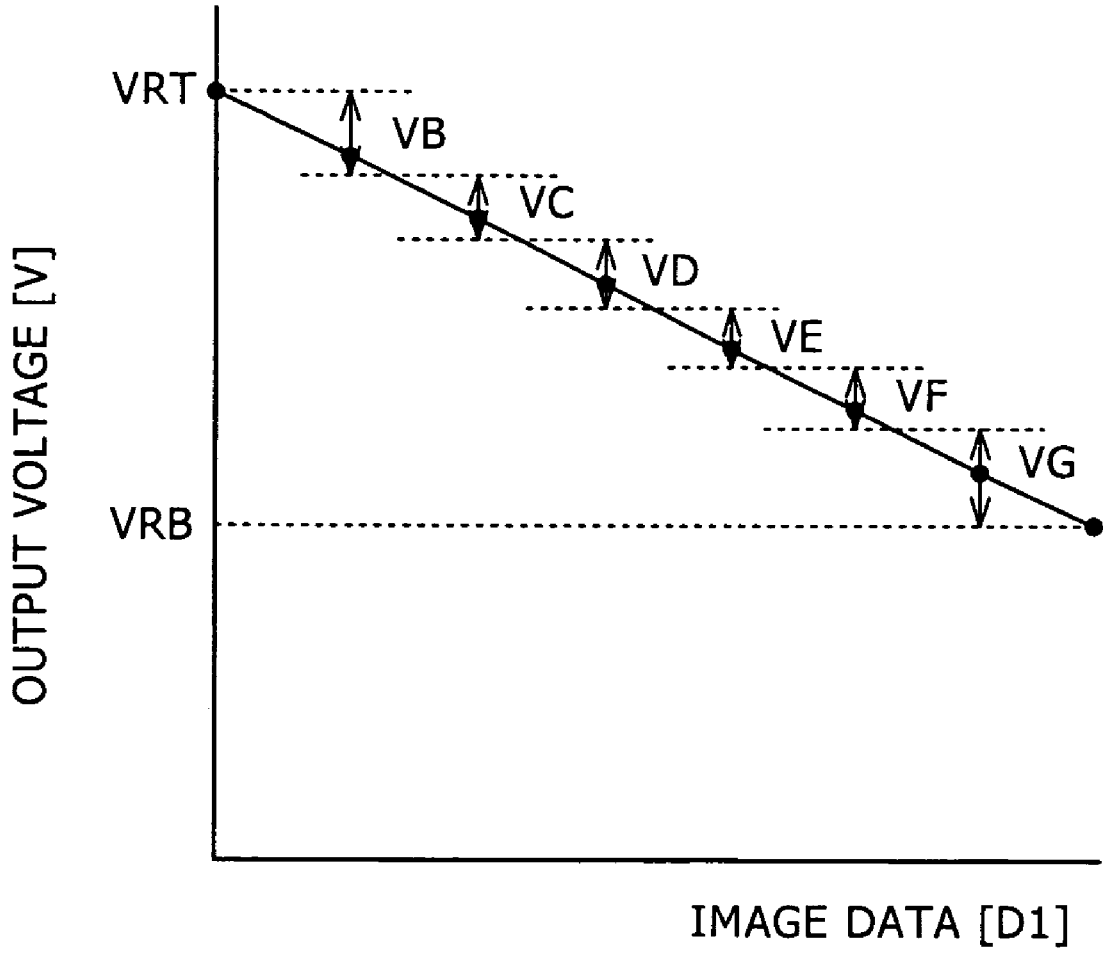
FIG. 16 is a characteristic diagram illustrating dynamic range adjustment in the gamma characteristic according to the configuration of FIG. 13.

When the PDA 41 is shipped from a factory, the light emission characteristic of each color of the display section 44 constructed using an organic EL element is measured, and original reference voltage setting data DV for indicating setting of original reference voltages VRT, VB to VG, VRB described hereinabove with reference to FIG. 13 are recorded for each color into a memory 50. Consequently, the PDA 41 can set the original reference voltages VRT, VB to VG, VRB using the original reference voltage setting data DV and correct dispersion in light emission characteristic for each color and dispersion in light emission characteristic among products. Therefore, the PDA 41 can display a display image with a correct white balance and correct color reproducibility.

It is to be noted that, in the present embodiment, the original reference voltage VRT which exhibits the highest voltage and the original reference voltage VRB which exhibits the lowest voltage from among the original reference voltages VRT, VB to VG, VRB are original reference voltages corresponding to the gradations of the black level and the white level, respectively. Thus, in the following description, the two original reference voltages VRT and VRB are referred to as black level original reference voltage VRT and white level original reference voltage VRB, respectively. Further, the black level original reference voltage VRT and the white level original reference voltage VRB are set through rough adjustment with original reference voltage setting data for rough adjustment and then through fine adjustment with original reference voltage setting data for fine adjustment, and therefore, data for rough adjustment from within the original reference voltage setting data DV corresponding to the black level original reference voltage VRT and the white level original reference voltage VRB are referred to suitably as black level rough adjustment original reference voltage setting data and white level rough adjustment original reference voltage setting data and represented by DVVRT-AT, DVVRT-AB and DVVRB-AT, DVVRB-AB, respectively. Further, data for fine adjustment are referred to as black level fine adjustment original voltage setting data and white level fine adjustment original reference voltage setting data and represented by DVVRT-B and DVVRB-B, respectively. Further, corresponding to them, the original reference voltage setting data DV relating to the original reference voltages VB to VG are represented by reference characters DVVB to DVVG. Consequently, the memory 50 stores black level rough adjustment original reference voltage setting data DVVRT-AT and DVVRT-AB, white level rough adjustment original reference voltage setting data DVVRB-AT and DVVRB-AB, black level fine adjustment original reference voltage setting data DVVRT-B, white level fine adjustment original reference voltage setting data DVVRB-B and original reference voltage setting data DVVB to DVVG.

Further, the PDA 41 is configured such that it can cope with a secular change in light emission characteristic in accordance with a liking of a user and that it can execute a predetermined processing procedure by means of the controller 43 to adjust the white balance, black level and white level of the display section 44. A result of the adjustment is recorded into and held by a memory 45, and the display of the display section 44 is set based on the result of the adjustment. When the PDA 41 is shipped from a factory, correction data D2 for the original reference voltage setting data DVVRT-AT, DVVRT-AB, DVVRT-B, DVVRB-AT, DVVRB-AB and DVVRB-B which relate to the white level and the black level from among the original reference voltage setting data DVVRT-AT, DVVRT-AB, DVVRT-B, DVVB to DVVG, DVVRB-AT, DVVRB-AB and DVVRB-B recorded in the memory 50 and representing data upon shipment from a factory are recorded and retained in the form of difference data ΔDVVRT-AT, ΔDVVRT-AB, ΔDVVRT-B, ΔDVVRB-AT, ΔDVVRB-AB and ΔDVVRB-B corresponding to the original reference voltage setting data DVVRT-AT, DVVRT-AB, DVVRT-B, DVVRB-AT, DVVRB-AB and DVVRB-B in and by the memory 45. The correction data D2 recorded in the memory 45 are outputted to a controller 47 at a timing based on processing of the controller 47. Consequently, such a result of adjustment such as white balance adjustment as described above is recorded and retained, and the display of the display section 44 is set based on the result of the adjustment.

The controller 47 is formed from an integrated circuit, and time division multiplexes image data DR, DG, DB of the different colors outputted from the apparatus body 42 in a unit of a line to produce a single system of image data D1 and outputs the image data D1. Further, the controller 47 corrects the original reference voltage setting data DV stored in the memory 50 with the correction data D2 outputted from the controller 43 of the apparatus body 42 and outputs resulting data to a horizontal drive circuit 55.

In particular, in the controller 47, a timing generator (TG) 58 produces and outputs various timing signals synchronized with the image data D1 and DR to DB. A memory control circuit 59 controls operation of a memory 60 with reference to the timing signals. The memory 60 successively stores and outputs the image data DR to DB outputted from the apparatus body 42 thereby to time division multiplex the image data DR, DG, DB in a unit of a line to produce image data D1 and output the image data D1.

A memory control circuit 61 controls operation of the memory 50 to read out original reference voltage setting data DV from the memory 50 in a horizontal scanning period and outputs the original reference voltage setting data DV to an original reference voltage setting circuit 63.

Figure 3:
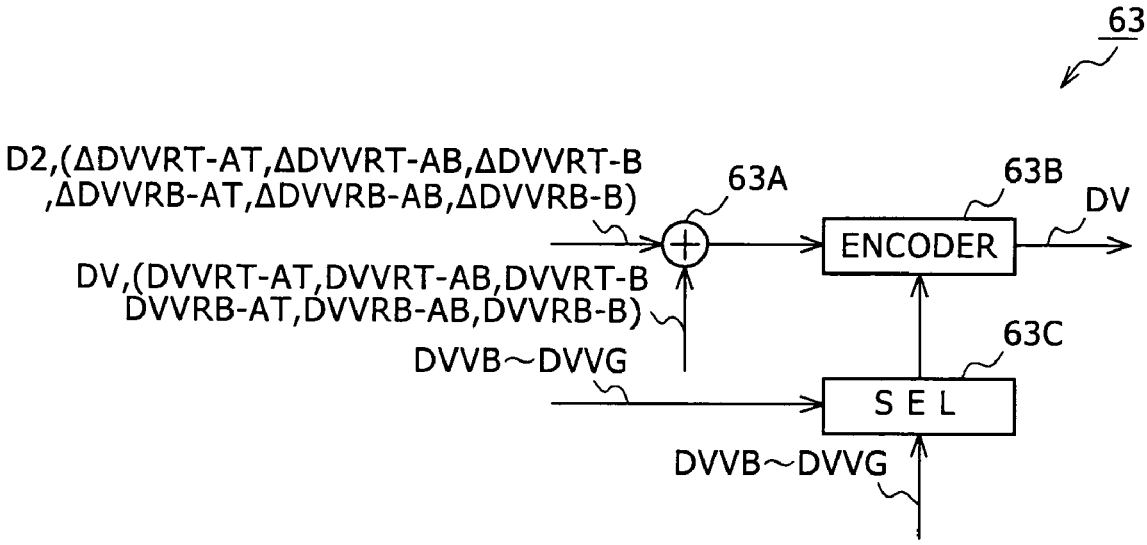
FIG. 3 is a block diagram showing a block diagram showing the original reference voltage production circuit and a reference voltage production circuit of FIG. 1.

The original reference voltage setting circuit 63 corrects and outputs the original reference voltage setting data DV outputted from the memory control circuit 61 with the correction data D2 outputted from the controller 43 of the apparatus body 42. In particular, as seen from FIG. 3, the original reference voltage setting circuit 63 inputs, from among the original reference voltage setting data DVVRT-AT, DVVRT-AB, DVVRT-B, DVVB to DVVG, DVVRB-AT, DVVRB-AB and DVVRB-B inputted thereto through the memory control circuit 61, the original reference voltage setting data DVVRT-AT, DVVRT-AB, DVVRT-B, DVVRB-AT, DVVRB-AB and DVVRB-B which relate to the white level and the black level to an addition circuit 63A. The addition circuit 63A adds the corresponding correction data D2 (ΔDVVRT-AT, ΔDVVRT-AB, ΔDVVRT-B, ΔDVVRB-AT, ΔDVVRB-AB and ΔDVVRB-B) outputted from the controller 43 to the original reference voltage setting data DVVRT-AT, DVVRT-AB, DVVRT-B, DVVRB-AT, DVVRB-AB and DVVRB-B which relate to the white level and the black level to correct the original reference voltage setting data DVVRT-AT, DVVRT-AB, DVVRT-B, DVVRB-AT, DVVRB-AB and DVVRB-B. Further, the original reference voltage setting data DVVRT-AT, DVVRT-AB, DVVRT-B, DVVRB-AT, DVVRB-AB and DVVRB-B corrected in this manner are inputted to an encoder 63B and also the remaining original reference voltage setting data DVVB to DVVG are inputted to the encoder 63B, and the encoder 63B converts the inputted data into serial data and outputs the serial data. It is to be noted that the original reference voltage setting circuit 63 can output, depending upon setting of a selector 63C, original reference voltage setting data outputted separately from the apparatus body 42 in place of the original reference voltage setting data DVVB to DVVG outputted from the memory control circuit 61 in this manner.

In the series of processes described above, the original reference voltage setting circuit 63 outputs original reference voltage setting data DV corresponding to driving of the signal lines SIG of the display section 44. In the present embodiment, however, the display section 44 is configured such that pixels of red, green and blue which are contiguous in a horizontal direction are set as one group and the pixels of one group are driven time divisionally with a single driving signal so that the original reference voltage setting circuit 63 can switchably output the original reference voltage setting data DV for image data DR, DG, DB of red, green and blue within a period of one horizontal scanning period.

The horizontal drive circuit 55 is formed from an integrated circuit separate from that of the controller 47 and distributes image data D1 outputted from the controller 47 into different pixel groups each including red, green and blue pixels contiguous to each other in the horizontal direction by means of the shift register 13 and then converts the distributed data from digital into analog data by means of the digital to analog conversion circuits 15A to 15N each formed from a selector. Further, driving signals which depend upon results of the digital to analog process by the digital to analog conversion circuits 15A to 15N are amplified by the amplification circuits 16A to 16N and outputted to the display section 44. Consequently, the display section 44 distributes the output signals of the digital to analog conversion circuits 15A to 15N to the signal lines SIG by means of the selectors 17A to 17N, respectively.

The horizontal drive circuit 55 produces reference voltages V1 to V64 for the digital to analog conversion circuits 15A to 15N which perform such a series of processes as described above in response to the original reference voltage setting data, DVVRT-AT, DVVRT-AB, DVVRT-B, DVVRB-AT, DVVRB-AB and DVVRB-B by means of an original reference voltage production circuit 70 and a reference voltage production circuit 69.

Figure 1:
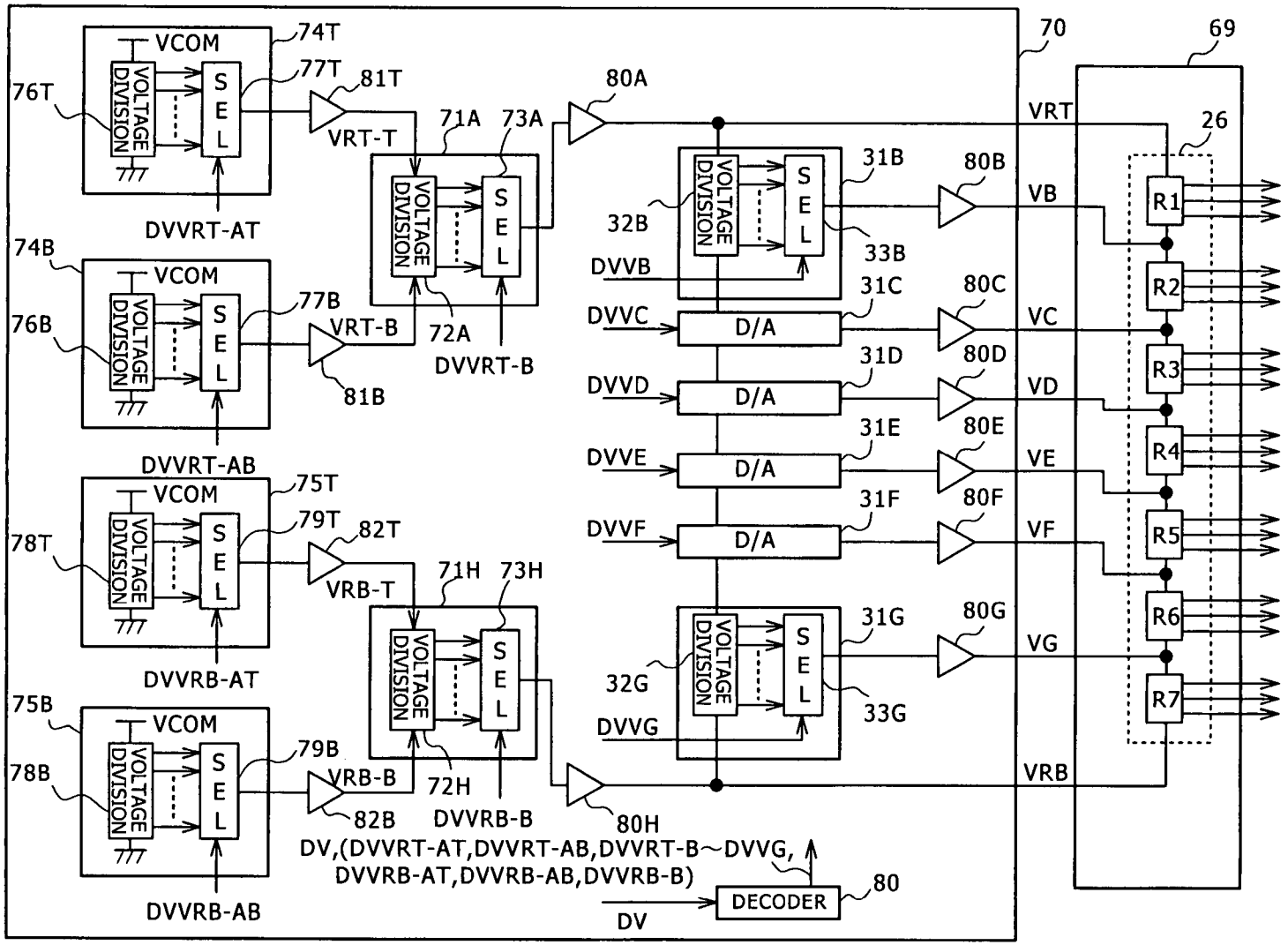
FIG. 1 is a block diagram showing an original reference voltage production circuit for a personal digital assistant according to a first embodiment of the present invention.

FIG. 1 shows in block diagram the original reference voltage production circuit 70 and the reference voltage production circuit 69. The reference voltage production circuit 69 is formed in a same configuration as that of the reference voltage production circuit 14 described hereinabove with reference to FIG. 13 except that it eliminates the amplification circuits 27A to 27H and produces and outputs reference voltages V1 to V64 by resistor voltage division from the original reference voltages VRT, VB to VG, VRB outputted from the original reference voltage production circuit 70.

The original reference voltage production circuit 70 produces the original reference voltages VB to VG other than the black level original reference voltage VRT and the white level original reference voltage VRB by means of the digital to analog conversion circuits 31B to 31G similarly as in the original reference voltage production circuit 30 described hereinabove with reference to FIG. 13. In particular, the original reference voltage production circuit 70 produces a plurality of different candidate voltages for the original reference voltages VB to VG by resistor voltage division by means of the voltage dividing circuits 32B to 32G and selectively inputs the candidate voltages to amplification circuits 80B to 80G in response to original reference voltage setting data DV (DVVB to DVVG) by means of the selectors 33B to 33G so that the amplification circuits 80B to 80G may output the original reference voltages VB to VG, respectively. Further, the voltage dividing circuits 32B to 32G used for production of candidate voltages for the original reference voltages VB to VG are connected in series between the digital to analog conversion circuits 31B to 31G so as to be connected to the black level original reference voltage VRT and the white level original reference voltage VRB by digital to analog conversion circuits 71A and 71H. Consequently, the PDA 41 need not re-adjust, when the black level original reference voltage VRT and the white level original reference voltage VRB are varied to perform black level adjustment and dynamic range adjustment, the other original reference voltages VB to VG, and consequently, the adjustment operation can be simplified as much.

Meanwhile, the digital to analog conversion circuits 71A and 71H individually produce a plurality of different candidate voltages for the original reference voltages VRT and VRB by resistor voltage division by means of voltage dividing circuits 72A and 72H, respectively. The candidate voltages are selected in response to the fine adjustment original reference voltage setting data DVVRT-B and DVVRB-B by means of selectors 73A and 73H to produce original reference voltages VRT and VRB, and the original reference voltages VRT and VRB are outputted through amplification circuits 80A and 80H, respectively.

The original reference voltages VRT and VRB are produced in such a manner as described above. The digital to analog conversion circuit 71A for converting the black level original reference voltage VRT receives the reference voltages VRT-T and VRT-B outputted from power supply circuits 74T and 74B at the opposite ends of the voltage dividing circuit 72A thereof and produces candidate voltages from the reference voltages VRT-T and VRT-B. The power supply circuits 74T and 74B individually divide a reference voltage production voltage VCOM by means of voltage dividing circuits 76T and 76B to produce a plurality of candidate voltages and selectively outputs the candidate voltages in response to the black level rough adjustment original reference voltage setting data DVVRT-AT and DVVRT-AB by means of selectors 77T and 77B thereby to produce reference voltages VRT-T and VRT-B, respectively. The power supply circuits 74T and 74B output the reference voltages VRT-T and VRT-B through amplification circuits 81T and 81B, respectively.

Consequently, in the original reference voltage production circuit 70, the reference voltage production voltage VCOM is divided in two stages by resistor voltage division to produce the black level original reference voltage VRT. Consequently, the original reference voltage production circuit 70 can enhance the resolution of the black level original reference voltage VRT to raise the accuracy in adjustment as much when compared with the configuration described hereinabove with reference to FIG. 13.

On the other hand, the digital to analog conversion circuit 71H which relates to the white level original reference voltage VRB inputs reference voltages VRB-T and VRB-B outputted from power supply circuits 75T and 75B to the opposite ends of the voltage dividing circuit 72H so that candidate voltages are produced from the reference voltages VRB-T and VRB-B. The power supply circuits 75T and 75B divide the reference voltage production voltage VCOM by means of voltage dividing circuits 78T and 78B to individually produce candidate voltages and selectively output the candidate voltages in response to the white level rough adjustment original reference voltage setting data DVVRB-AT and DVVRB-AB by means of selectors 79T and 79B thereby to produce reference voltages VRB-T and VRB-B, respectively. The power supply circuits 75T and 75B output the reference voltages VRB-T and VRB-B through amplification circuits 82T and 82B, respectively. Consequently, in the original reference voltage production circuit 70, also the white level original reference voltage VRB is produced by dividing the reference voltage production voltage VCOM in two stages by resistor voltage division, and the resolution of the original reference voltage VRB can be enhanced as much to increase the accuracy in adjustment when compared with the configuration described hereinabove with reference to FIG. 13.

Each of the selectors 73A, 73H, 77T, 77B, 79T and 79B provided in the original reference voltage production circuit 70 in the present embodiment has 64 input terminals corresponding to the original reference voltage setting data DV of 6 bits, and corresponding to this, the voltage dividing circuits 72A, 72H, 76T, 76B, 78T and 78B are formed from resistors having an equal resistance value. Consequently, where the reference voltage production voltage VCOM is set to 5 V, the original reference voltages VRT and VRB can be produced with a resolution of approximately 1.35 mV in the maximum (5,000 [mV]×1/64×1/64). It is to be noted that, in the original reference voltage production circuit 70, also the remaining selectors 33B to 33G and voltage dividing circuits 32B to 32G are configured so as to be compatible with the original reference voltage setting data DV of 6 bits similarly to the selectors 73A and so forth and the voltage dividing circuits 32B and so forth.

A decoder 80 successively fetches the original reference voltage setting data DV outputted from the controller 47 and selectively outputs the original reference voltage setting data DV to the digital to analog conversion circuit 71A, 31B to 31G and 71H and the power supply circuits 74T, 74B, 75T and 75B at timings corresponding to changeover of contacts in the selectors 17A to 17N.

In the PDA 41 having the configuration described above, it is possible to roughly adjust the black level and the dynamic range with the black level rough adjustment original reference voltage setting data DVVRT-AT and DVVRT-AB and the white level rough adjustment original reference voltage setting data DVVRB-AT and DVVRB-AB first and then finely adjust the black level and the dynamic range with the black level fine adjustment original reference voltage setting data DVVRT-B and the white level fine adjustment original reference voltage setting data DVVRB-B to adjust the original reference voltages VRT and VRB with a high degree of accuracy to prevent color drift.

Figure 4A:
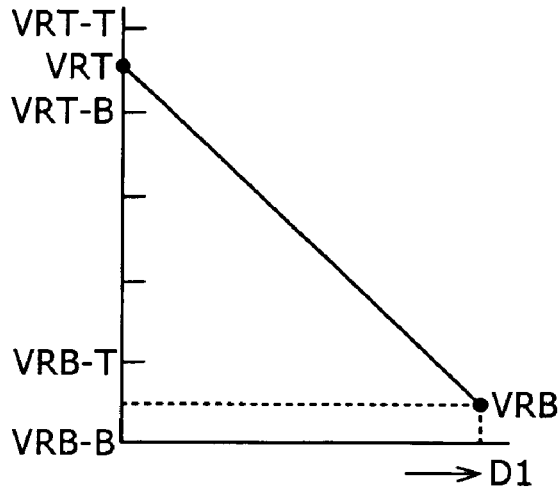
FIGS. 4A to 4C are characteristic diagrams illustrating black level adjustment in the personal digital assistant of FIG. 2.

In particular, for the black level adjustment, the selectors 73A and 73H of the digital to analog conversion circuits 71A and 71H, the selectors 77T and 79T of the power supply circuits 74T and 75T and the selectors 77B and 79B of the power supply circuits 74B and 75B in the PDA 41 are set to operate in the following manner in response to the original reference voltage setting data DV according to standard setting as seen in FIG. 4A. In particular, the selectors 73A and 73H of the digital to analog conversion circuits 71A and 71H are set so as to select a candidate voltage of a central potential from among a plurality of candidate voltages outputted from the voltage dividing circuits 72A and 72H, respectively. The selectors 77T and 79T are set so as to output predetermined reference voltages VRT-T and VRB-T from the power supply circuits 74T and 75T, respectively. The selectors 77B and 79B are set so as to output reference voltages VRT-B and VRB-B lower by a voltage corresponding to one digit to the power supply circuits 74T and 75T, respectively.

Figure 4B:
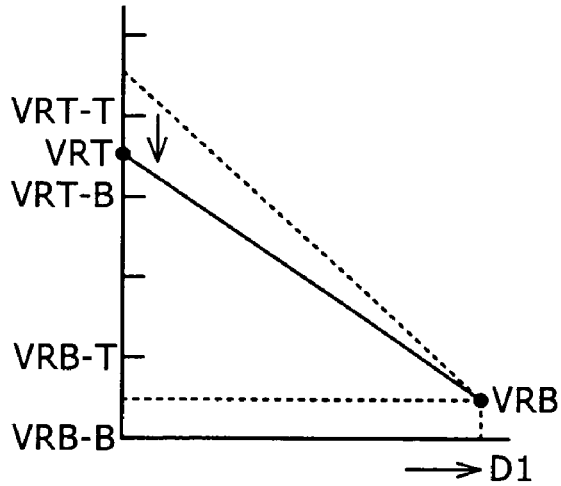
Figure 4C:
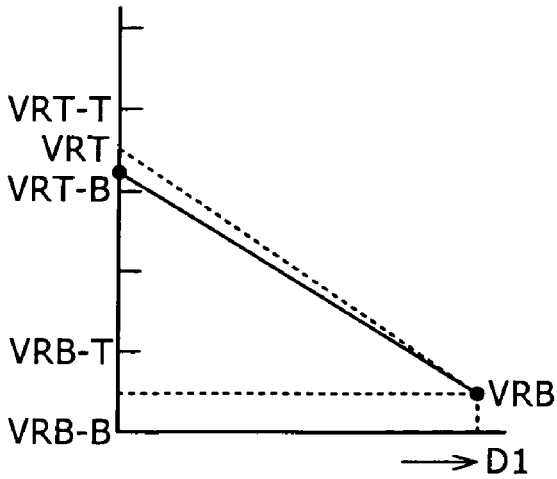

In this state, in the PDA 41, the black level rough adjustment original reference voltage setting data DVVRT-AT and DVVRT-AB are varied to vary the reference voltages VRT-T and VRT-B to be inputted to the digital to analog conversion circuit 71A in an interlocking relationship as seen from an arrow mark in FIG. 4B thereby to roughly adjust the black level. In this instance, however, where the reference voltage production voltage VCOM is 5,000 mV, since the black level rough adjustment original reference voltage setting data DVVRT-AT and DVVRT-AB are 6-bit data, the black level original reference voltage VRT is roughly adjusted with a resolution of approximately 80 mV (5,000 [mv]×1/64). Thereafter, the black level fine adjustment original reference voltage setting data DVVRT-B is varied to finely adjust the black level original reference voltage VRT as seen in FIG. 4C. In this instance, since also the black level fine adjustment original reference voltage setting data DVVRT-B is 6-bit data, the black level original reference voltage VRT roughly adjusted with the resolution of approximately 80 mV in accordance with the black level rough adjustment original reference voltage setting data DVVRT-AT and DVVRT-AB is finely adjusted with a resolution of approximately 1.35 mV (80 [mV]×1/64).

Figure 5A:
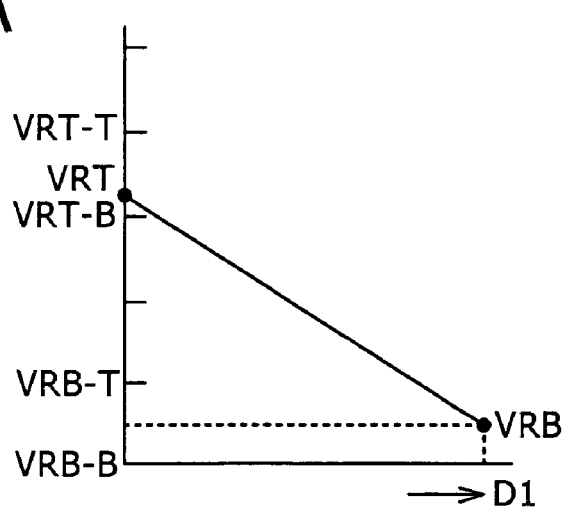
FIGS. 5A to 5C are characteristic diagrams illustrating white level adjustment in the personal digital assistant of FIG. 2.
Figure 5B:
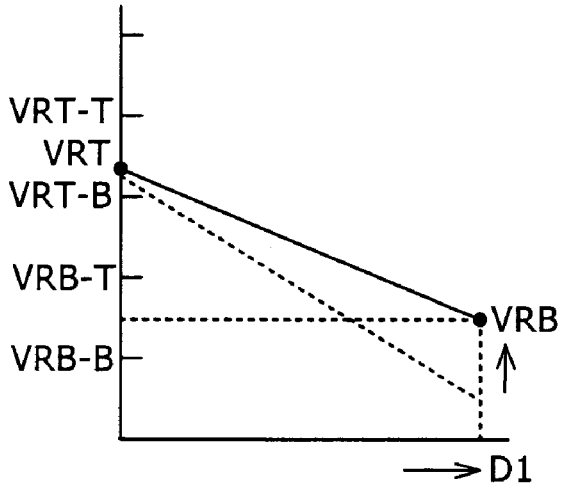
Figure 5C:
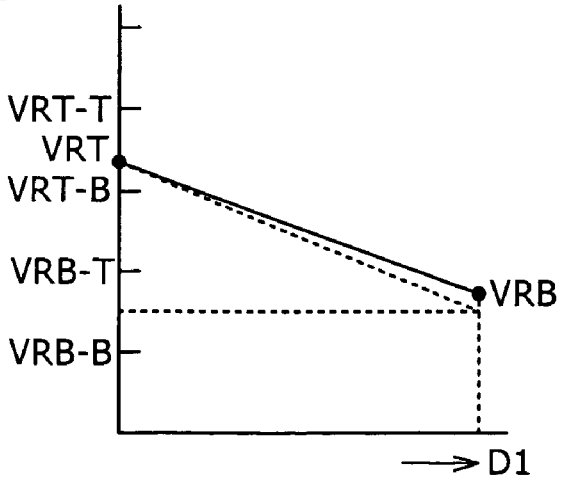

In the state wherein the black level is roughly adjusted in such a manner as described above, the white level rough adjustment original reference voltage setting data DVVRB-AT and DVVRB-AB are varied as seen in FIG. 5A so that the reference voltages VRB-T and VRB-B to be inputted to the digital to analog conversion circuit 71H are varied in an interlocking relationship as indicated by an arrow mark in FIG. 5B to roughly adjust the white level. Also in this instance, where the reference voltage production voltage VCOM is 5 V, since the white level rough adjustment original reference voltage setting data DVVRB-AT and DVVRB-AB are 6-bit data, the white level original reference voltage VRB is roughly adjusted with a resolution of approximately 80 mV (5,000 [mv]×1/64). Thereafter, the white level fine adjustment original reference voltage setting data DVVRB-B is varied to finely adjust the white level original reference voltage VRB as seen in FIG. 5C. In this instance, since also the white level fine adjustment original reference voltage setting data DVVRB-B is 6-bit data, the white level original reference voltage VRB roughly adjusted with the resolution of approximately 80 mV in accordance with the white level rough adjustment original reference voltage setting data DVVRB-AT and DVVRB-AB is finely adjusted with a resolution of approximately 1.35 mV (80 [mV]×1/64).

In the PDA 41, such adjustment operations relating to the black level and the white level as described above are executed for each color, and consequently, the color drift is adjusted with a high degree of accuracy. Further, the original reference voltage setting data DV are recorded in and retained by the memory 50 so that the state according to such adjustment operations may be regenerated.

Figure 6:
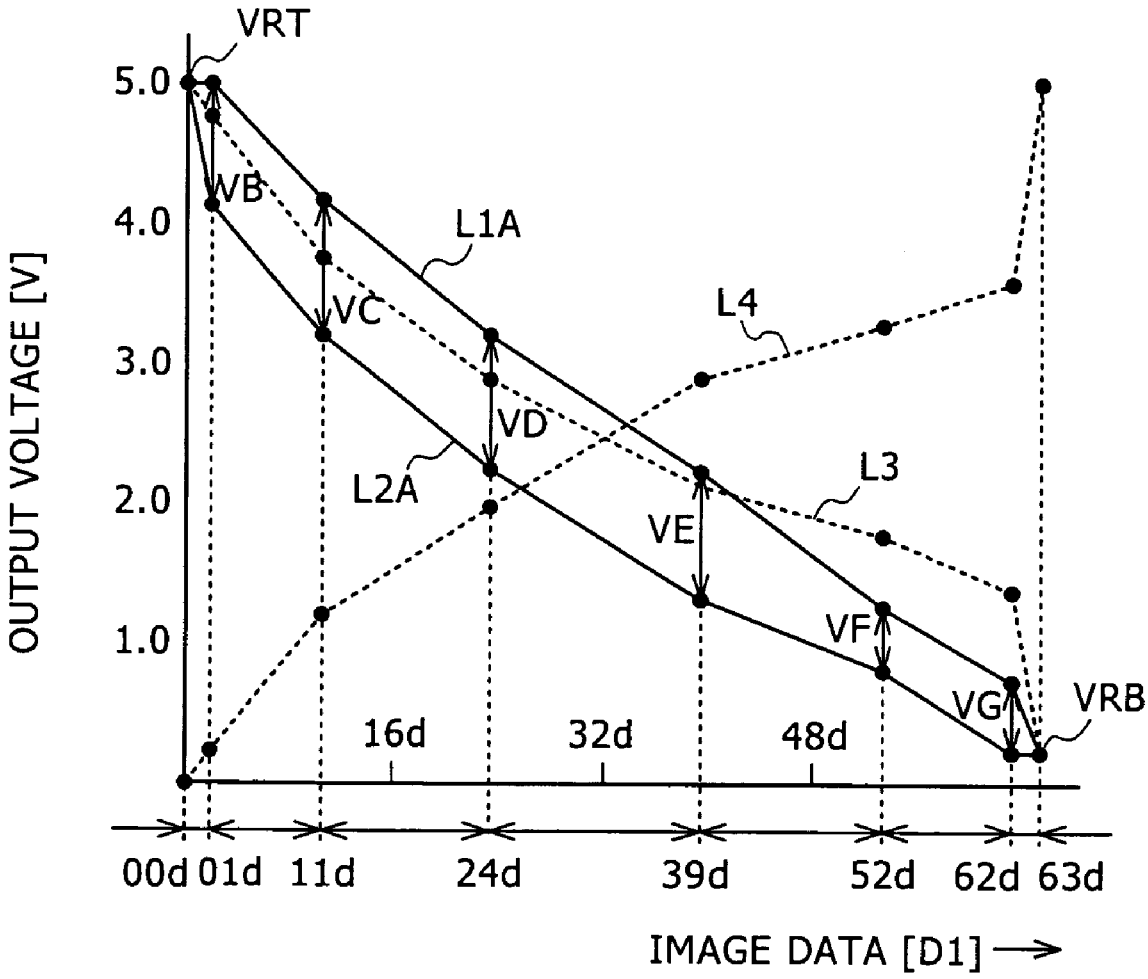
FIG. 6 is a characteristic diagram illustrating a gamma characteristic based on setting of the original reference voltage production circuit of FIG. 1.

FIG. 6 is a characteristic diagram illustrating an example of a gamma characteristic implemented in such a manner as described above. In the present embodiment, the gamma characteristic can be varied, for example, from that indicated by a characteristic curve denoted by reference character L1A to that indicated by another characteristic curve denoted by L2A depending upon the setting of the original reference voltage setting data DV. Consequently, a desired image can be displayed with a desired gamma characteristic. Further, the black level and the white level can be set for each color and for each product depending upon the setting of the black level original reference voltage setting data DVVRT (DVVRT-AT, DVVRB-AT, DVVRT-B) and the setting of the white level original reference voltage setting data DVVRB (DVVRB-AT, DVVRB-AB, DVVRB-B) so as to cope with the dispersion in light emission characteristic and a secular change of the light emission characteristic for each color and for each product. Furthermore, two kinds of data are stored in the memory 50 so as to cope with line inversion or changeover of the correction data D2 corresponding to line inversion is performed so that also those gamma characteristics relating to a liquid crystal display panel denoted by reference characters L3 and L4 may be implemented.

2. Operation of the Embodiment

In the PDA 41 (FIG. 2) having such a configuration as described above, image data DR to DB to be used for display are inputted from the apparatus body 42 to the controller 47 and time division multiplexed through the memory 60 so that image data of the same colors may be contiguous in a unit of a line. Then, image data D1 which are a result of the time division multiplexing process are inputted to the horizontal drive circuit 55. In the horizontal drive circuit 55, the image data D1 are fetched into the shift register 13, and the image data of the same colors are inputted simultaneously and concurrently into the digital to analog conversion circuits 15A to 15N in a unit of a line. Further, the image data are converted into driving signals by a digital to analog conversion process by the digital to analog conversion circuits 15A to 15N, and the driving signals are inputted to the selectors 17A to 17N through the amplification circuits 16A to 16N, respectively. Consequently, the image data D1 are distributed to the combinations of the pixels of red, green and blue formed from electronic EL elements, which are disposed successively and cyclically in a horizontal direction in the order of red, green and blue in the display section 44. Thereafter, the image data D1 are converted into driving signals, which are distributed to the signal lines SIG for the red, green and blue pixels by the selectors 17A to 17N. As a result, in the PDA 41, the gradations of the individual pixels are set in accordance with the image data DR to DB to display a desired image.

Meanwhile, in the original reference voltage production circuit 70 (FIG. 1), a plurality of original reference voltages VRT, VB to VG, VRB are produced. The original reference voltages VRT, VB to VG, VRB are divided by the reference voltage production circuit 69, which is a resistor series circuit wherein a plurality of voltage dividing circuits R1 to R7 each formed from a predetermined number of resistors connected in series are connected in series, to form reference voltages V1 to V64. The reference voltages V1 to V64 are selected by the digital to analog conversion circuits 15A to 15N to convert the image data D1 from digital into analog signals to produce driving signals. Consequently, the driving signals having a gamma characteristic are produced by polygonal line approximation set with the original reference voltages VRT, VB to VG, VRB to display an image.

However, although the organic EL elements do not have dispersion in gamma characteristic itself, they have different light emission characteristics which are different among different colors and among different products and exhibit a variation in light emission characteristic by a secular change. Therefore, in the PDA 41, the black level original reference voltage VRT and the white level original reference voltage VRB are divided by the voltage dividing circuits 32B to 32G to produce the original reference voltages VB to VG, and the original reference voltages VRT, VB to VG, VRB are divided by the voltage dividing circuits R1 to R7 to produce the reference voltages V1 to V64. Thus, it is necessary to convert the image data DR to DB from digital into analog data to produce driving signals and set the black level original reference voltage VRT and the white level original reference voltage VRB for each color and for each product to correct them so as to cope with a secular change.

To this end, in the PDA 41, the light emission characteristic is measured for each color and for each product, and the original reference voltage setting data DVVRT-AT, DVVRT-AB, DVVRT-B, DVVB to DVVG, DVVRB-AT, DVVRB-AB and DVVRB-B which indicate setting of the original reference voltages VRT, VB to VG, VRB are recorded into and retained in the memory 50 based on a result of the measurement so that a desired light emission characteristic may be assured. Further, the correction data D2 for correcting the secular change of the light emission characteristics are recorded into the memory 45. In the PDA 41, the original reference voltage setting circuit 63 corrects the original reference voltage setting data DV with the correction data D2 and successively input the corrected original reference voltage setting data DV to the horizontal drive circuit 55 in a corresponding relationship to time division multiplexing of the image data D1.

In the horizontal drive circuit 55, the original reference voltage setting data DVVRT-AT, DVVRT-AB, DVVRT-B, DVVB to DVVG, DVVRB-AT, DVVRB-AB and DVVRB-B are divided into the series of the original reference voltages VRT, VB to VG, VRB by the decoder 80, and the original reference voltage setting data DVVRT-AT, DVVRT-AB, DVVRT-B, DVVB to DVVG, DVVRB-AT, DVVRB-AB and DVVRB-B are processed by the power supply circuits 74T and 74B, digital to analog conversion circuits 71A, 31B to 31G and 71H and power supply circuits 75T and 75B to produce the original reference voltages VRT, VB to VG, VRB.

Consequently, in the present embodiment, driving signals can be produced so as to cope with various light emission characteristics depending upon the setting of the original reference voltage setting data DVVRT-AT, DVVRT-AB, DVVRT-B, DVVB to DVVG, DVVRB-AT, DVVRB-AB and DVVRB-B. Consequently, the driving signals can cope with various display panels readily and rapidly. In particular, since dynamic range adjustment and black level adjustment are performed and besides the gamma characteristic can be varied by mere change of the data, the period of time required for development can be reduced significantly when compared with the prior art and also the labor required for the development can be reduced.

Consequently, also the dispersion in light emission characteristic among different colors and among different products and the variation in light emission characteristic by a secular change can be coped with flexibly. Thus, such dispersion in characteristic as described above, a displacement in white balance by a secular change and deterioration of the color reproducibility can be prevented effectively thereby to provide a display image of a high quality.

Since the original reference voltages VRT, VB to VG, VRB are set with the original reference voltage setting data DVVRT-AT, DVVRT-AB, DVVRT-B, DVVB to DVVG, DVVRB-AT, DVVRB-AB and DVVRB-B so that various light emission characteristics can be achieved in this manner, in the PDA 41, for the original reference voltages VB to VG except the black level original reference voltage VRT and the white level original reference voltage VRB, a plurality of candidate voltages for the original reference voltages VB to VG are produced by resistor voltage division of the original reference voltages VRT and VRB by the voltage dividing circuits 32B to 32G in a state wherein the original reference voltages VRT and VRB are connected to the opposite ends of the series connection circuit of the voltage dividing circuits 32B to 32G. Then, the candidate voltages are selected with the original reference voltage setting data DVVB to DVVG to produce the original reference voltages VB to VG.

Consequently, the original reference voltages VB to VG are controlled so that they can vary only within individual ranges of the candidate voltages outputted from the voltage dividing circuits 32B to 32G individually connected in series. Consequently, in the PDA 41, even if the original reference voltage setting data DV are set in error because of invasion of noise, outputting of driving signals of an extreme gamma characteristic can be prevented and significant deterioration of the picture quality by noise can be prevented.

Further, since the opposite ends of the voltage dividing circuits 32B to 32G individually connected in series in this manner are connected to the black level original reference voltage VRT and the white level original reference voltage VRB, when the original reference voltages VRT and VRB are varied by dynamic range adjustment or black level adjustment, also the original reference voltages VB to VG vary following up the variations of the original reference voltages VRT and VRB at resistor voltage division ratios by the voltage dividing circuits 32B to 32G connected in series. Therefore, a process for re-setting the original reference voltages VB to VG can be omitted, and consequently, an adjustment operation of the PDA 41 can be simplified.

On the other hand, as regards the black level original reference voltage VRT and the white level original reference voltage VRB, divided voltages of the reference voltage production voltage VCOM by the voltage dividing circuits 76T, 76B, 78T and 78B are selected by the selectors 77T and 77B, 79T and 79B, respectively, in response to the black level rough adjustment original reference voltage setting data DVVRT-AT and DVVRT-AB and the white level rough adjustment original reference voltage setting data DVVRB-AT and DVVRB-AB to set the potentials at the opposite ends of the voltage dividing circuits 72A and 72H, and a plurality of candidate voltages for the original reference voltages VRT and VRB are produced by the voltage dividing circuits 72A and 72H. Further, the candidate voltages are selected with the black level fine adjustment original reference voltage setting data DVVRT-B and the white level fine adjustment original reference voltage setting data DVVRB-B to produce the original reference voltages VRT and VRB, respectively. Consequently, in the present embodiment, after the white level and the black level are roughly adjusted each with a resolution of 6 bits with the rough adjustment original reference voltage setting data DVVRT-AT, DVVRT-AB, DVVRB-AT and DVVRB-AB, the gradations of 1 digit obtained by the rough adjustment can be finely adjusted further with a resolution of 6 bits with the fine adjustment original reference voltage setting data DVVRT-B and DVVRB-B. Consequently, the black level and the dynamic range can be adjusted with a higher degree of accuracy than those in the prior art and appearance of the color drift can be prevented efficiently.

In such a configuration for the original reference voltages VRT and VRB as described above, it is only necessary to additionally provide four systems each including a combination of a voltage dividing circuit having substantially the same configuration as that of the digital to analog conversion circuits 31B to 31G and a selector, and the accuracy in adjustment can be enhanced by a configuration simplified in this manner.

While the accuracy in adjustment is assured in this manner, the original reference voltages VRT and VRB can be set variously within a range from the reference voltage production voltage VCOM to 0 V. Consequently, the original reference voltages VRT and VRB can be applied widely, for example, to a horizontal drive circuit of a liquid crystal panel and so forth, and therefore, the flexibility can be assured.

Further, where the original reference voltages VRT, VB to VG, VRB are set with the original reference voltage setting data DV in this manner and the original reference voltage setting data DV are changed over in response to a time division multiplexing process for transmission of the image data D1, a system of an original reference voltage production circuit can be applied commonly for a process of image data of the individual colors, and consequently, the general configuration can be simplified.

Further, in the PDA 41, the original reference voltage setting data DV are outputted to change over the gamma characteristic three times for one line after all. Consequently, even if the gamma characteristic is set in error, for example, by invasion of noise, the setting error of the gamma by an influence of noise can be restricted to the one line. Also this decreases the deterioration of the picture quality by noise.

Further, in the PDA 41, since the original reference voltages VRT, VB to VG, VRB are set with the original reference voltage setting data DV in this manner and the original reference voltage production circuit for producing the black level original reference voltage VRT is provided on the reference voltage production circuit side and integrated into an integrated circuit together with the reference voltage production circuit, the reference voltage production circuit 69 can omit amplification circuits to be used for inputting of the original reference voltages VRT, VB to VG, VRB. Since the amplification circuits are not required in this manner, the accuracy of the original reference voltages VRT, VB to VG, VRB to be inputted to the reference voltage production circuit can be likewise enhanced. Consequently, the accuracy of the reference voltages V1 to V64 can be enhanced and the productivity can be enhanced.

3. Effects of the Embodiment

With the liquid crystal display apparatus 1 having such a configuration as described above, since a plurality of candidate voltages produced by a voltage dividing circuit are selected in response to original reference voltage setting data to produce original reference voltages and reference voltages for digital to analog conversion are produced from the original reference voltages such that, with regard to the original reference voltages which relate the potentials at the opposite ends of the voltage dividing circuit, the reference voltage for production is varied with rough adjustment data, and with regard to the remaining original reference voltages, voltage dividing circuits are connected in series to produce the original reference voltages which relates to the potentials at the opposite ends of the voltage dividing circuits so that the light emission characteristic can be corrected variously. Consequently, the color adjustment can be performed with a high degree of accuracy with a simple and easy configuration.

Further, where the original reference voltages relating to the potentials at the opposite ends of the voltage dividing circuits are produced by selection of a plurality of divided voltages produced by voltage division of a voltage for reference voltage production, a horizontal drive circuit can be applied commonly, for example, to a liquid crystal display panel and an organic EL panel.

Second Embodiment

Figure 7:
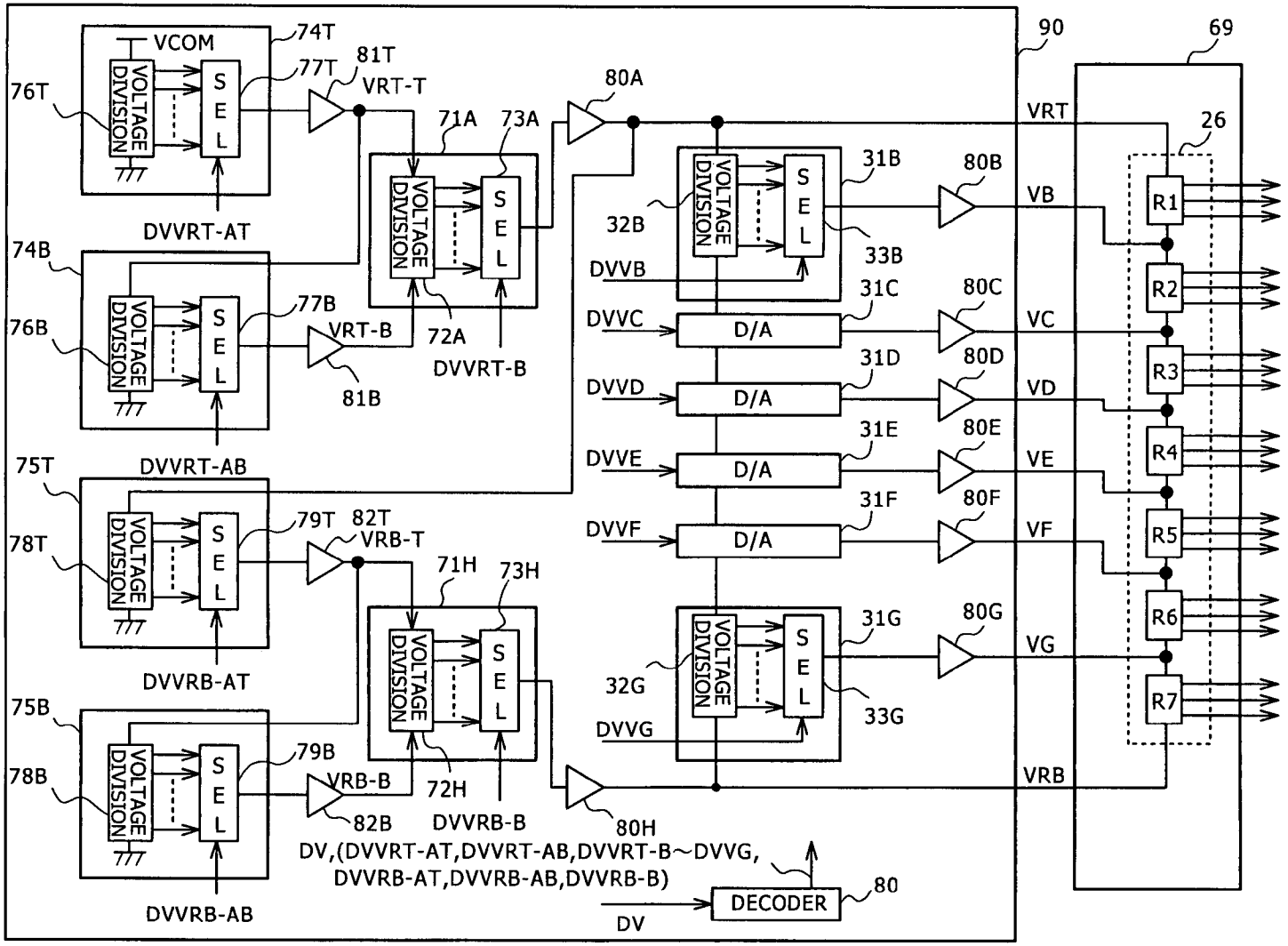
FIG. 7 is a block diagram showing an original reference voltage production circuit for a personal digital assistant according to a second embodiment of the present invention.
Figure 8:
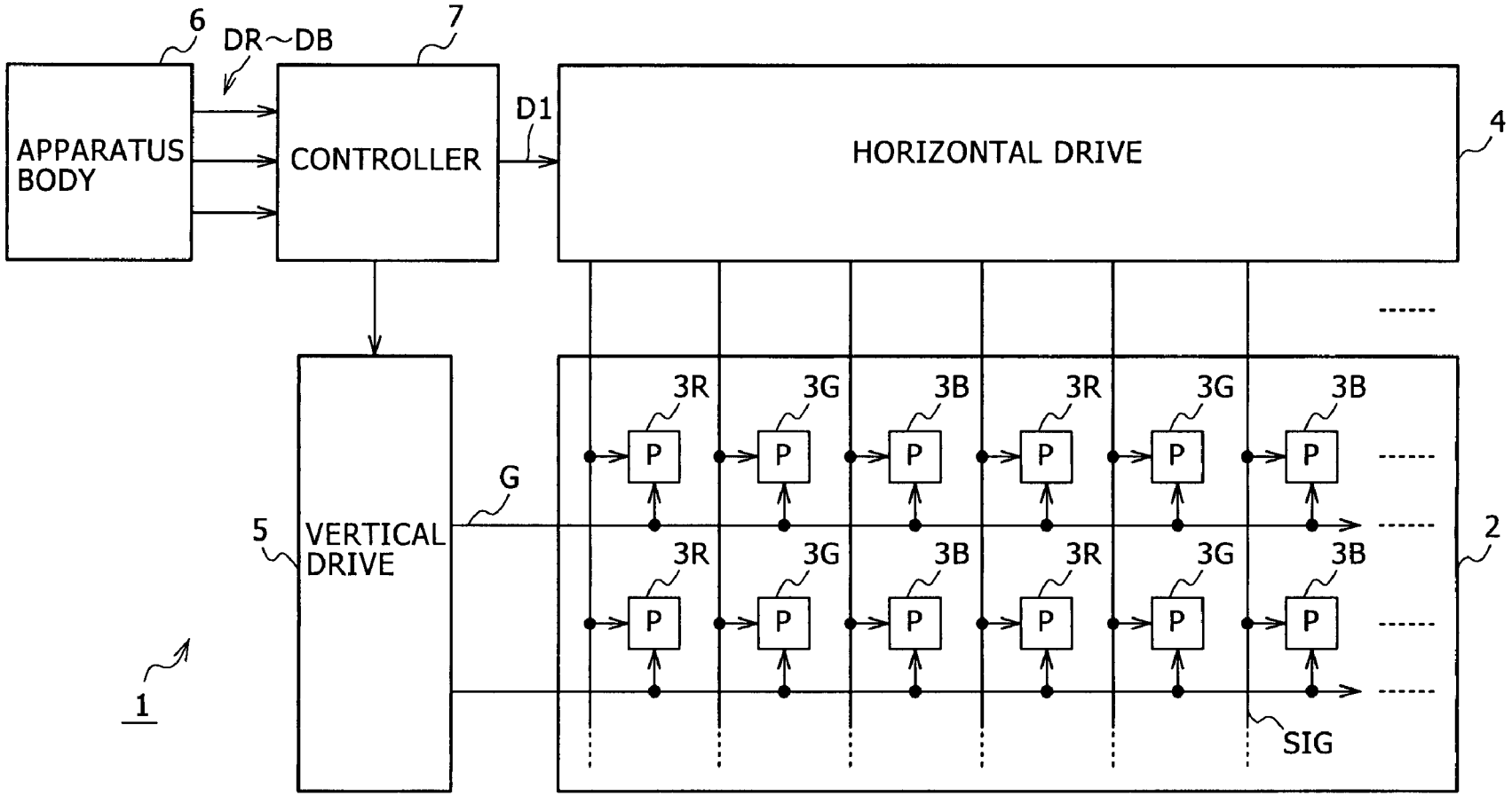
FIG. 8 is a block diagram showing a conventional liquid crystal display apparatus.

FIG. 7 is a block diagram showing an original reference voltage production circuit and a reference voltage production circuit which are applied to a PDA according to a second embodiment of the present invention in comparison with FIG. 1. Referring to FIG. 7, the PDA including the original reference voltage production circuit 90 and the reference voltage production circuit 69 shown has a configuration the same as that of the PDA 41 of the first embodiment described hereinabove except that the power supply circuits 74B, 75T and 75B are connected in a different manner from that in the configuration of FIG. 1 and applied to a horizontal drive circuit for exclusive use for organic EL devices. It is to be noted that overlapping description with that of the first embodiment is omitted in the following description.

Also in the second embodiment, the original reference voltage production circuit 90 produces original reference voltages VRT, VB to VG, VRB based on the original reference voltage setting data DVVRT-AT, DVVRT-AB, DVVRT-B, DVVB to DVVG, DVVRB-AT, DVVRB-AB and DVVRB-B and can therefore achieve the same effects as those of the first embodiment.

Further, in the present embodiment, the power supply circuit 74B is supplied with the reference voltage VRT-T outputted from the power supply circuit 74T in place of the reference voltage production voltage VCOM. Consequently, even if the voltage dividing circuits 76T and 76B of the power supply circuits 74T and 74B are dispersed, the original reference voltages VRT and VRB can be kept at a voltage lower than the reference voltage VRT-T outputted from the power supply circuit 74T. Consequently, in the original reference voltage production circuit 90, the black level original reference voltage VRT always satisfies a relationship of VCOM≧VRT-T≧VRT≧VRT-B, and deterioration of the accuracy in adjustment which is caused by dissatisfaction of the relationship by a dispersion of the voltage dividing circuits 76T and 76B is prevented and the accuracy in adjustment is further enhanced.

Further, the reference voltage VRT-T outputted from the power supply circuit 74T is supplied in place of the reference voltage production voltage VCOM so that the resolution of the divided voltages to be outputted from the voltage dividing circuit 76B of the power supply circuit 74B is varied in response to the reference voltage VRT-T. Also this further enhances the accuracy in adjustment. In particular, where the reference voltage VRT-T is set, for example, to 5 V to perform black level adjustment with a comparatively great dynamic range, the divided voltages outputted from the voltage dividing circuit 76B of the power supply circuit 74B have a resolution of approximately 80 mV (5,000 [mV]×1/64). However, where the reference voltage VRT-T is set, for example, to 4 V to perform black level adjustment with a comparatively small dynamic range, the divided voltages outputted from the voltage dividing circuit 76B of the power supply circuit 74B have another resolution of approximately 60 mV (4,000 [mV]×1/64). Consequently, where the reference voltage VRT-T is set to 5 V, the black level original reference voltage VRT is outputted with a resolution of approximately 1.35 mV (80 [mV]×1/64) whereas, where the reference voltage VRT-T is set to 4 V, the black level original reference voltage VRT is outputted with another resolution of approximately 1 mV (60 [mV]×1/64). Consequently, where the black level is adjusted with a small dynamic range, it can be adjusted with a resolution smaller as much, and consequently, the accuracy in adjustment can be further enhanced.

Similarly, in the power supply circuit 75B, the voltage dividing circuit 78B is supplied with the reference voltage VRB-T outputted from the power supply circuit 75T in place of the reference voltage production voltage VCOM. Consequently, even if the voltage dividing circuits 78T and 78B of the power supply circuits 75T and 75B are dispersed, the voltage VRB-B as a reference for production can be kept at a voltage lower than the voltage VRB-T as a reference for production outputted from the power supply circuit 75T. Consequently, in the original reference voltage production circuit 90, also the white level original reference voltage VRB is kept to satisfy a relationship of VRB-T≧VRB≧VRB-B≧0 without fail, and deterioration of the accuracy adjustment caused by dissatisfaction of the relationship by a dispersion of the voltage dividing circuits 78T and 78B is prevented and the accuracy in adjustment is further enhanced.

Furthermore, in the power supply circuit 75T, the voltage dividing circuit 78T is supplied with the original reference voltage VRT in place of the reference voltage production voltage VCOM. Consequently, the original reference voltage production circuit 90 is configured such that it inputs the original reference voltage VRT on the other end side which is the higher voltage side to one end of the voltage dividing circuit 78T and the divided voltages from the voltage dividing circuit 78T are selectively outputted to one end of the voltage dividing circuit 72H for production of an original reference voltage in response to the rough adjustment data DVVRB-AT. Consequently, even when the voltage dividing circuits 76T, 72A, 76B, 78T, 72H and 78B on the black level side and the white level side are dispersed, the voltage level of the white level original reference voltage VRB is kept so that it does not become higher than the black level original reference voltage VRT. Consequently, the original reference voltage production circuit 90 keeps the black level original reference voltage VRT and the white level original reference voltage VRB so as to satisfy the relationship of VRT≧VRB and deterioration of the accuracy in adjustment caused by dissatisfaction of the relationship by various dispersions is prevented and the accuracy in adjustment is further enhanced.

Further, since the relationship of VRT≧VRB is maintained, even if the rough adjustment data DVVRT-AT, DVVRT-AB, DVVRB-AT and DVVRB-AB are set in error, it is possible to prevent the white level original reference voltage VRB for the voltage dividing circuit 72H from exceeding the original reference voltage VRT of the higher voltage side. Where the white level original reference voltage VRB is set so as not to exceed the original reference voltage VRT of the higher voltage side in this manner, also the original reference voltages VB to VG which are produced with reference to the original reference voltages VRT and VRB can be set so that the voltage drops successively, and consequently, an extreme gamma characteristic which may caused by, for example, noise can be prevented effectively.

Further, the black level original reference voltage VRT is supplied to the voltage dividing circuit 78T in place of the reference voltage production voltage VCOM in this manner so that the resolution of the divided voltages to be outputted from the voltage dividing circuit 78T of the power supply circuit 75T is varied in response to the original reference voltage VRT, and also this further enhances the accuracy in adjustment. In particular, for example, where the black level original reference voltage VRT is set to 5 V to perform white level adjustment with a comparatively great dynamic range, while the divided voltages outputted from the voltage dividing circuit 78T of the power supply circuit 75T have a resolution of approximately 80 mV (5,000 [mV]×1/64), where the black level original reference voltage VRT is set, for example, to 4 V to perform white level adjustment with a relatively small dynamic range, the divided voltages outputted from the voltage dividing circuit 78T of the power supply circuit 75T has another resolution of 60 mV (4,000 [mv]×1/64). Consequently, where the original reference voltage VRT is set to 5 v, the original reference voltage VRB is outputted with a resolution of approximately 1.35 mV (80 [mV]×1/64) whereas, where the black level original reference voltage VRT is set to 4 V, the white level original reference voltage VRB is outputted with another resolution of approximately 1 mV (60 [mV]×1/64). Consequently, where the white level is adjusted with a comparatively small dynamic range, it can be adjusted with a resolution lower as much, and consequently, the accuracy in adjustment can be further enhanced.

Where the configuration of FIG. 7 is used, the original reference voltage VRT on the other end side is inputted to one end of the voltage dividing circuit 78T to produce the reference voltage VRB-T for rough adjustment with reference to the original reference voltage VRT on the other end side. Thus, color adjustment can be performed with a degree of accuracy higher than that in the first embodiment, and an extreme gamma characteristic by noise and so forth can be prevented further effectively.

Third Embodiment

Figure 17:
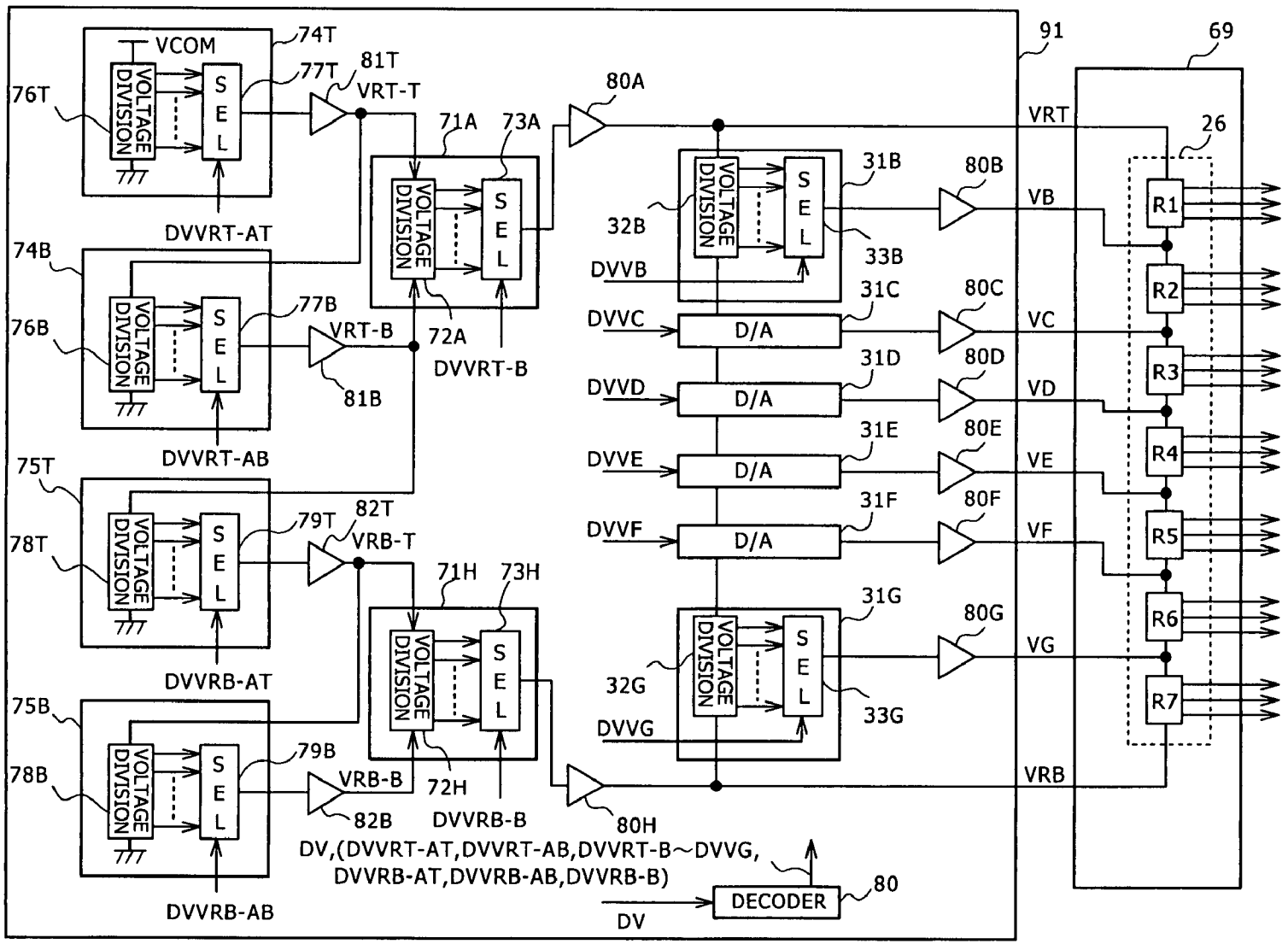
FIG. 17 is a block diagram showing an original reference voltage production circuit for a personal digital assistance according to a third embodiment of the present invention.

FIG. 17 is a block diagram showing an original reference voltage production circuit and a reference voltage production circuit which are applied to a PDA according to a third embodiment of the present invention in comparison with FIG. 7. Referring to FIG. 17, the original reference voltage production circuit 91 shown has a configuration the same as the original reference voltage production circuit 90 of the second embodiment described above except that the reference voltage VRT-B outputted from the power supply circuit 74B on the black level side is supplied to the power supply circuit 75T in place of the black level original reference voltage VRT so that the black level original reference voltage VRT and the white level original reference voltage VRB are kept so as to have a relationship of the VRT≧VRB Consequently, also with the present third embodiment, the accuracy in adjustment can be further enhanced and an influence of noise and so forth can be prevented effectively.

Other Embodiments

In the Embodiments 2 and 3 described hereinabove, in production of the original reference voltage at the lower voltage side end, the reference voltage VRB-T is produced with reference to an output of the power supply circuit for the original reference voltage on the other end side. However, the present invention is not limited to this, but such a configuration as just described may be applied also to production of the original reference voltage at the higher voltage side end.

Further, while, in the first embodiment, a voltage dividing circuit is provided in each of the power supply circuits 74T, 74B and 75T, 75B, the present invention is not limited to this, but the voltage dividing circuit may be used commonly by the power supply circuits.

Further, while, in the embodiments described above, the present invention is applied to a PDA, the present invention is not limited to this but can be applied widely to various video apparatuses.

In particular, the present invention can be applied to drive circuits for a flat display apparatus and a flat display apparatus and applied, for example, to a display apparatus which is configured using organic EL devices.

While preferred embodiments of the present invention have been described using specific terms, such description is for illustrative purpose only, and it is to be understood that changes and variations may be made without departing from the spirit or scope of the following claims.

What is claimed is:

1. A drive circuit for a flat display apparatus wherein driving signals are produced by a digital to analog conversion process of image data and are used to drive signal lines of a display section wherein pixels are arranged in a matrix, comprising:

an original reference voltage production circuit for producing a plurality of original reference voltages;

a reference voltage production circuit formed from a plurality of voltage dividing circuits connected in series and each including a plurality of resistors connected in series and receiving the original reference voltages at the opposite ends of and at nodes between said voltage dividing circuits to output divided voltages by said voltage dividing circuits as a plurality reference voltages;

a plurality of selection circuits for receiving the reference voltages as inputs thereto and selectively outputting the inputted reference voltages in accordance with the image data for the corresponding ones of said signal lines as the driving signals; and an input circuit for inputting original reference voltage setting data indicating setting of the original reference voltages;

said original reference voltage production circuit including a plurality of digital to analog conversion circuits for producing a plurality of candidate voltages for the original reference voltages by means of a voltage dividing circuit for original reference voltage production and selectively outputting the candidate voltages in response to the original reference voltage setting data to produce the original reference voltages corresponding to the original reference voltage setting data;

those of said digital analog conversion circuits which are for the original reference voltages other than the potentials at the opposite ends of said voltage dividing circuits being formed such that the voltage dividing circuits for original reference voltage production thereof are connected in series and the original reference voltages of the potentials at the opposite ends of said voltage dividing circuits are inputted to the opposite ends of the voltage dividing circuits for original reference voltage production;

each of those of said digital to analog conversion circuit which are for the original reference voltages of the potentials at the opposite ends of said voltage dividing circuits including a power supply circuit for varying the voltage across said voltage dividing circuits for original reference voltage production in response to data for rough adjustment.

2. The drive circuit for a flat display apparatus according to claim 1, wherein said power supply circuit selects a plurality of divided voltages produced by voltage division of a voltage for reference voltage production in response to the data for rough adjustment by means of a selection circuit and outputs the selected divided voltage to one end of said voltage dividing circuits for original reference voltage production.

3. The drive circuit for a flat display apparatus according to claim 1, wherein said power supply circuit inputs the original reference voltage on the other end side to one end of said voltage dividing circuits, selects the divided voltages from said voltage dividing circuits in response to the data for rough adjustment by means of a selection circuit and outputs the selected divided voltage to the one end of said voltage dividing circuits for original reference voltage production.

4. The drive circuit for a flat display apparatus according to claim 1, wherein said power supply circuit inputs an output voltage thereof for the reference voltage on the other end side to one end of said voltage dividing circuits, selects the divided voltages from said voltage dividing circuits in response to the rough adjustment data by means of a selection circuit and outputs the selected divided voltage to one end of said voltage dividing circuits for original reference voltage production.

5. A flat display apparatus for displaying an image based on image data, comprising:

a display section including pixels arranged in a matrix; and a horizontal drive circuit for driving signal lines of said display section with driving signals;

said horizontal drive circuit including:

an original reference voltage production circuit for producing a plurality of original reference voltages;

a reference voltage production circuit formed from a plurality of voltage dividing circuits connected in series and each including a plurality of resistors connected in series and receiving the original reference voltages at the opposite ends of and at nodes between said voltage dividing circuits to output divided voltages by said voltage dividing circuits as a plurality reference voltages;

a plurality of selection circuits for receiving the reference voltages as inputs thereto and selectively outputting the inputted reference voltages in accordance with the image data for the corresponding ones of said signal lines as the driving signals; and an input circuit for inputting original reference voltage setting data indicating setting of the original reference voltages;

said original reference voltage production circuit including a plurality of digital to analog conversion circuits for producing a plurality of candidate voltages for the original reference voltages by means of a voltage dividing circuit for original reference voltage production and selectively outputting the candidate voltages in response to the original reference voltage setting data to produce the original reference voltages corresponding to the original reference voltage setting data;

those of said digital analog conversion circuits which are for the original reference voltages other than the potentials at the opposite ends of said voltage dividing circuits being formed such that the voltage dividing circuits for original reference voltage production thereof are connected in series and the original reference voltages of the potentials at the opposite ends of said voltage dividing circuits are inputted to the opposite ends of the voltage dividing circuits for original reference voltage production;

each of those of said digital to analog conversion circuit which are for the original reference voltages of the potentials at the opposite ends of said voltage dividing circuits including a power supply circuit for varying the voltage across said voltage dividing circuits for original reference voltage production in response to data for rough adjustment.

* * * * *